US010250001B2

(12) United States Patent
Kawamura et al.

(10) Patent No.: US 10,250,001 B2
(45) Date of Patent: Apr. 2, 2019

(54) WIRE CRIMPING DEVICE

(71) Applicants: FURUKAWA ELECTRIC CO., LTD., Tokyo (JP); FURUKAWA AUTOMOTIVE SYSTEMS INC., Shiga (JP)

(72) Inventors: Yukihiro Kawamura, Shiga (JP); Satoshi Takamura, Shiga (JP); Takeshi Hyotani, Shiga (JP); Koichi Kitagawa, Shiga (JP); Eiji Aramaki, Shiga (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 631 days.

(21) Appl. No.: 14/832,737

(22) Filed: Aug. 21, 2015

(65) Prior Publication Data

US 2015/0357782 A1 Dec. 10, 2015

Related U.S. Application Data

(63) Continuation of application No. PCT/JP2013/085282, filed on Dec. 28, 2013.

(30) Foreign Application Priority Data

Feb. 23, 2013 (JP) ..... 2013-033971

(51) Int. Cl.
*H01R 43/048* (2006.01)
*H01R 43/052* (2006.01)
(Continued)

(52) U.S. Cl.
CPC ..... *H01R 43/048* (2013.01); *H01R 4/20* (2013.01); *H01R 43/052* (2013.01); *H01R 4/62* (2013.01);
(Continued)

(58) Field of Classification Search
CPC .... H01R 43/05; H01R 43/052; H01R 43/048; H01R 43/055; Y10T 29/49185; Y10T 29/49192; Y10T 29/53235
See application file for complete search history.

(56) References Cited

U.S. PATENT DOCUMENTS 4,232,443 A 11/1980 Lichtenstein et al.
4,654,952 A * 4/1987 Baldyga ..... H01R 43/048 29/566.2
(Continued)

FOREIGN PATENT DOCUMENTS

CN 101 82831 3 A 9/2010
CN 101931129 A 12/2010
(Continued)

OTHER PUBLICATIONS

Office Action dated Apr. 15, 2014 in Japanese Patent Application No. 2014-508205 (with unedited computer generated English translation).
(Continued)

*Primary Examiner* — Livius Radu Cazan
(74) *Attorney, Agent, or Firm* — Oblon, McClelland, Maier & Neustadt, L.L.P.

(57) ABSTRACT

A wire crimping device includes: a wire crimping unit which crimps a crimping section into which a wire tip is inserted from a wire insertion opening which opens on a proximal end side of the crimping section in a long length direction; and a guiding unit which guides a distal end portion of an aluminum lead line to the wire insertion opening of a female crimp terminal arranged at a predetermined position for being crimped by the wire crimping unit, wherein an inner diameter of an opposedly facing portion of the guiding unit
(Continued)

which opposedly faces the wire insertion opening is set in conformity with an inner diameter of the wire insertion opening.

7 Claims, 23 Drawing Sheets

(51) Int. Cl.

| | |
|---|---|
| ***H01R 43/055*** | (2006.01) |
| ***H01R 4/20*** | (2006.01) |
| *H01R 43/05* | (2006.01) |
| *H01R 4/62* | (2006.01) |
| *H01R 13/11* | (2006.01) |

(52) U.S. Cl.
CPC ..... *H01R 13/113* (2013.01); *H01R 43/05* (2013.01); *H01R 43/055* (2013.01); *Y10T 29/4922* (2015.01); *Y10T 29/49185* (2015.01); *Y10T 29/49192* (2015.01); *Y10T 29/53235* (2015.01)

(56) References Cited

U.S. PATENT DOCUMENTS

| | | | | |
|---|---|---|---|---|
| 2004/0007041 | A1* | 1/2004 | Imgrut ..... | H01R 43/0486 72/412 |
| 2010/0081325 | A1* | 4/2010 | Matsunaga ..... | H01R 4/185 439/585 |

FOREIGN PATENT DOCUMENTS

| | | | |
|---|---|---|---|
| DE | 140 947 | A1 | 4/1980 |
| JP | 57-143690 | | 9/1982 |
| JP | 57-143690 | A | 9/1982 |
| JP | 58-106889 | U | 7/1983 |
| JP | 59-196589 | | 11/1984 |
| JP | 59-196589 | A | 11/1984 |
| JP | 61-133590 | | 6/1986 |
| JP | 61-133590 | A | 6/1986 |
| JP | 1-81891 | | 5/1989 |
| JP | 01-081891 | U1 | 5/1989 |
| JP | 7-14659 | | 1/1995 |
| JP | 07-014659 | A | 1/1995 |
| JP | 7-27086 | | 5/1995 |
| JP | 9-82449 | | 3/1997 |
| JP | 09-082449 | A | 3/1997 |
| JP | 11-77191 | | 3/1999 |
| JP | 11-077191 | A | 3/1999 |
| JP | 2001-291570 | | 10/2001 |
| JP | 2001-291570 | A | 10/2001 |
| JP | 2006-331931 | A | 12/2006 |
| JP | 2010-157420 | | 7/2010 |
| JP | 2010-157420 | A | 7/2010 |
| JP | 2010-538436 | A | 12/2010 |

OTHER PUBLICATIONS

Office Action dated Aug. 5, 2014 in Japanese Patent Application No. 2014-103446 (with unedited computer generated English translation).

Combined Chinese Office Action and Search Report dated Dec. 2, 2016 in Chinese Patent Application No. 201380073609.5 (with English language translation).

Office Action dated Jun. 2, 2014 in Japanese Patent Application No. 2014-508205 (with unedited computer generated English translation).

Office Action dated Sep. 26, 2014 in Japanese Patent Application No. 2014-103446 (with unedited computer generated English translation).

Written Opinion dated Apr. 1, 2014 in PCT/JP2013/085282 (with English translation).

Chinese Notice of Decision of Granting Patent Right for Invention dated May 4, 2017 in Patent Application No. 201380073609.5 (with English Translation).

International Search Report dated Apr. 1, 2014 in International application No. PCT/JP2013/085282 (with English translation), filed Dec. 28, 2013.

* cited by examiner

WIRE CRIMPING DEVICE

TECHNICAL FIELD

The present invention relates to a wire crimping device and a wire crimping method for connecting by crimping a terminal fitting of a terminal connecting strip which is constituted of a carrier formed in a strip shape and a plurality of terminal fittings which project from at least one edge side of the carrier in the width direction to a wire tip where a conductor is exposed by peeling off an insulating cover on a distal end side of an insulated wire.

BACKGROUND ART

As a crimp terminal, there have been used an open-barrel-type crimp terminal and a closed-barrel-type crimp terminal. The open-barrel-type crimp terminal includes a barrel member which crimps a wire tip formed by peeling off an insulating cover on a distal end side of the insulated wire, the barrel member obtained by bending a material from both sides in the width direction and making edge portions of the both sides face each other in an opposed manner at an intermediate portion. The closed-barrel-type crimp terminal includes a crimping section formed into a hollow shape which allows the insertion of a wire tip into the inside of the crimping section through an insertion opening at a proximal end side.

In the case of the open-barrel-type crimp terminal, the crimping section is exposed under a severe in-use environment and hence, there exists a possibility that a surface of the crimping section and a surface of a conductor in a crimping connecting portion will corrode so that conductivity will be lowered.

In contrast, the closed-barrel-type crimp terminal is formed into a hollow shape and hence, a wire tip inserted into the crimp terminal is covered by the crimp terminal without any gap over the whole circumferential direction. Accordingly, it is considered that the conduction between the crimp terminal and the conductor of the insulated wire can be surely acquired and, at the same time, corrosion which may occur on the surface of the crimping section and on the surface of the conductor in the crimping connecting portion can be prevented.

On the other hand, a wire connection structural body is configured by connecting such a crimp terminal to an insulated wire. That is, the wire tip of the insulated wire is arranged in the crimping section of the crimp terminal and, thereafter, the crimp terminal is crimped to the wire tip by caulking the crimping section using a wire crimping device such as a terminal crimping device disclosed in Patent Document 1, for example.

However, in the case of the closed-barrel-type crimp terminal, to arrange the wire tip of the insulated wire on the crimping section of the crimp terminal, it is necessary to insert the wire tip of the insulated wire from an insertion opening formed on a proximal end side of the crimping section. However, from a viewpoint of water-blocking performance, an outer diameter of the insulated wire and an inner diameter of the crimping section are set substantially equal to each other, that is, these diameters are set such that there is substantially no gap between an outer periphery of an insulating cover section of the wire tip inserted into the crimping section and an inner periphery of the crimping section. Accordingly, the closed-barrel-type crimp terminal has a drawback that the insertion of the wire tip of the insulated wire into the crimp terminal is only possible after aligning the center of the wire tip and the center of the crimping section to each other.

PRIOR ART DOCUMENT

Patent Document

Patent Document 1: Japanese Unexamined Utility Model Publication No. H7-27086

SUMMARY OF THE INVENTION

Problems to be Solved by the Invention

Accordingly, it is an object of the present invention to provide a wire crimping device and a wire crimping method which can surely and efficiently perform crimping by smoothly inserting a wire tip into a hollow crimping section of a closed-barrel-type crimp terminal.

Solutions to the Problems

According to the present invention, there is provided a wire crimping device by which an insulated wire formed by covering a conductor with an insulating cover and provided with a wire tip formed by exposing the conductor by peeling off the insulating cover on a distal end side, and a closed-barrel-type crimp terminal provided with a hollow crimping section which allows the crimping connection of the wire tip are connected to each other by crimping the crimping section and the wire tip to each other, the wire crimping device including: a crimping means which crimps the crimping section into which the wire tip is inserted from a wire insertion opening which opens on a proximal end side of the crimping section in a terminal axis direction; and a guiding means which guides the wire tip to the wire insertion opening of the crimp terminal arranged at a predetermined position for enabling crimping by the crimping means, wherein an inner diameter of an opposedly facing portion of the guiding means which opposedly faces the wire insertion opening is set in conformity with an inner diameter of the wire insertion opening.

The conductor may be formed of a stranded wire formed by stranding raw wires or a single wire. Further, the conductor may be a copper-based conductor formed using the same type of metal as the crimp terminal formed using copper or a copper alloy, or may be an aluminum-based conductor formed by using a different metal such as aluminum or an aluminum alloy which is a less noble metal for a metal used for forming the crimp terminal.

The conductor may be a different-wire mixed wire where an aluminum-base conductor is arranged around a copper-based conductor or a different-wire mixed wire where a copper-based conductor is arranged around an aluminum-based conductor as an opposite case.

The above-mentioned hollow crimping section may be a circular-cylindrical or angular-cylindrical crimping section or a circular-cylindrical or angular-cylindrical crimping section having a shape where an end portion of the crimping section on a side opposite to the wire insertion opening is sealed.

The above-mentioned guiding means may be a mechanism which constitutes a part of the device or a member independent from the crimp terminal and the insulated wire.

According to the present invention, the wire tip can be smoothly inserted into the hollow crimping section of the closed-barrel-type crimp terminal.

This will be described in more detail. According to the present invention, the wire crimping device includes the crimping means which crimps the crimping section of the closed-barrel-type crimp terminal into which the wire tip is inserted from the wire insertion opening which opens on the proximal end side of the crimping section in the terminal axis direction, and the guiding means which guides the wire tip to the wire insertion opening of the crimp terminal arranged at a predetermined position for enabling crimping by the crimping means. The inner diameter of the opposedly facing portion of the guiding means which opposedly face the wire insertion opening is set in conformity with the inner diameter of the wire insertion opening. Accordingly, the wire tip can be smoothly inserted into the crimping section by being guided by a guiding means to the wire insertion opening of the crimping section which is crimped by the crimping means. In view of the above, even when the crimping section is formed such that an inner diameter of the crimping section in a pre-crimping state is set substantially equal to an outer diameter of the insulated wire from a viewpoint of water-blocking performance, the wire tip can be smoothly inserted into the crimping section and the crimping section can be crimped to the wire tip.

As described above, according to the present invention having the above-mentioned constitution, it is possible to surely and efficiently perform crimping by smoothly inserting the wire tip into the hollow crimping section of the closed-barrel-type crimp terminal.

As one mode of the present invention, the guiding means may be formed into a shape where an inner diameter of the guiding means is gradually increased toward the proximal end side in the terminal axis direction.

The above-mentioned shape where the inner diameter is gradually increased toward the proximal end side means a shape having a single-surface shape which is inclined linearly or in a curved manner from an opposedly facing portion which opposedly faces the wire insertion opening to a proximal end side.

According to the present invention, the wire tip is guided along the inner surface having the shape where a diameter is gradually increased and hence, the wire tip can be more smoothly guided to the wire insertion opening.

As another mode of the present invention, the guiding means may be arranged adjacent to the proximal end side of the crimping means in the terminal axis direction, the guiding means may be configured to be movable in a crimping direction of the crimping means, and the guiding means may be configured to be moved to a predetermined position with respect to the wire insertion opening prior to a crimping operation of the crimping means.

According to the present invention, at a timing different from a timing of the crimping operation of the crimping means arranged adjacent to the guiding means, that is, prior to the timing that the crimping section is crimped by the crimping means, the wire tip which is guided to the wire insertion opening by the guiding means which is moved to the predetermined position can be inserted into the crimping section. Accordingly, the crimping can be performed in a well-organized manner.

As another mode of the present invention, the guiding means may be configured to be mounted on the wire insertion opening prior to a crimping operation of the crimping means.

According to the present invention, at a timing different from a timing of the crimping operation of the crimping means, that is, prior to the timing that the crimping section is crimped by the crimping means, the wire tip which is guided to the wire insertion opening by the guiding means mounted at a predetermined position with respect to the wire insertion opening can be inserted into the crimping section. Accordingly, the crimping can be performed in a well-organized manner.

Assume a case where a guiding means formed of a separate member is mounted in the wire insertion opening. In such a case, for example, by forming a slit or the like through which the guiding means can be easily taken out after the crimp terminal and the insulated wire are connected to each other by crimping, a convenience of the wire crimping device can be further enhanced.

As another mode of the present invention, the guiding means may be constituted of a plurality of divided guiding portions.

For example, in a case where a guiding means formed of a separate member is mounted in the wire insertion opening, the guiding means constituted of divided guiding portions can be easily taken out after a crimp terminal and an insulated wire are connected to each other by crimping, for example. Accordingly, a convenience of the wire crimping device can be further enhanced.

As another mode of the present invention, the wire crimping device may further include: a carrier cutting means which is configured to separate a plurality of crimp terminals from a carrier of a terminal connection strip, the carrier formed in a strip-shape, the terminal connection strip formed by connecting the plurality of crimp terminals to the carrier via connecting portions at predetermined intervals in a long length direction of the carrier, wherein the carrier cutting means may be configured to shear the connecting portions in a thickness direction of the carrier by sliding in the thickness direction of the carrier from a stand-by position where the carrier cutting means overlaps with the wire insertion opening to a cutting position which is disposed on a side opposite to a side where the crimping section is arranged with respect to the carrier, the cutting position where the carrier cutting means does not overlap with the wire insertion opening, and the guiding means may be disposed at a position in the carrier cutting means which is made to slide to the cutting position, the position corresponding to the wire insertion opening.

According to the present invention, in the operation of the carrier cutting step of separating the crimp terminal and the carrier from each other by cutting the connecting portions, the guiding means is arranged at the predetermined position with respect to the wire insertion opening. Accordingly, the number of operations of the wire crimping device for crimping the crimping section is decreased and hence, the crimping section can be efficiently crimped.

As another mode of the present invention, the guiding means may be formed into a removal allowing shape so as to allow the insertion of the insulated wire with the wire tip guided to the wire insertion opening and the removal of the insulated wire in a direction which intersects with the terminal axis direction after crimping of the crimping section by the crimping means.

The above-mentioned removal allowing shape may be formed of a slit or the like formed in the guiding means which is formed of a elastic deformable member.

According to the present invention, the insulated wire having the wire tip thereof guided to the wire insertion opening can be easily taken out from the guiding means. Accordingly, the operability of the wire crimping device can be enhanced so that the crimping section can be efficiently crimped.

As another mode of the present invention, the removal allowing shape may be a C shape as viewed in the terminal axis direction.

According to the present invention, the insulated wire having the wire tip thereof guided to the wire insertion opening can be smoothly and easily taken out from the guiding means with the more simple constitution. Accordingly, the operability of the wire crimping device can be enhanced so that the crimping section can be efficiently crimped.

As another mode of the present invention, the guiding means may include a guiding and gripping means which grips the wire tip, and the wire crimping device may also include a moving means which moves at least one of the insulated wires gripped by the guiding and gripping means and the guiding and gripping means toward the crimping section in the terminal axis direction.

The above-mentioned guiding and gripping means which grips the wire tip may be in a gripping state to an extent that the wire tip is not movable in the long length direction of the wire relative to the guiding and gripping means, or in a gripping state to an extent that the wire tip is movable relative to the guiding and gripping means.

According to the present invention, the wire tip can be smoothly inserted into the hollow crimping section of the closed-barrel-type crimp terminal.

This will be described in more detail. At least one of the insulated wire gripped by the guiding and gripping means and the guiding and gripping means is moved in the terminal axis direction toward the crimping section by the moving means. Accordingly, the wire tip in a state where the wire tip is gripped by the guiding and gripping means is guided to the wire insertion opening so that the wire tip can be smoothly inserted into the crimping section.

As another mode of the present invention, the guiding and gripping means may be arranged adjacent to the proximal end side of the crimping section in the terminal axis direction, and the moving means may be configured to move at least one of the insulated wire and the guiding and gripping means toward the crimping section in the terminal axis direction prior to a crimping operation of the crimping means.

According to the present invention, at a timing different from a timing of the crimping operation of the crimping means, that is, prior to that where the crimping section is crimped by the crimping means, the wire tip which is gripped by the guiding and gripping means is guided to the wire insertion opening, and the wire tip is inserted into the crimping section. Accordingly, the crimping can be performed in a well-organized manner.

According to the present invention, there is also provided a wire crimping method for connecting an insulated wire formed by covering a conductor with an insulating cover and provided with a wire tip formed by exposing the conductor by peeling off the insulating cover on a distal end side, and a closed-barrel-type crimp terminal provided with a hollow crimping section which allows the crimping connection of the wire tip to each other by crimping the crimping section and the wire tip to each other, the wire crimping method includes: a wire insertion step of inserting the wire tip into the crimping section by guiding the wire tip to the wire insertion opening of the crimp terminal by a guiding means having an inner diameter of an opposedly facing portion which opposedly faces the wire insertion opening, the inner diameter set in conformity with an inner diameter of the wire insertion opening; and a crimping step of crimping the crimping section into which the wire tip is inserted from a wire insertion opening which opens on a proximal end side of the crimping section in a terminal axis direction.

According to the present invention, it is possible to surely and efficiently perform crimping by smoothly inserting the wire tip into the hollow crimping section of the closed-barrel-type crimp terminal.

As a mode of the present invention, the guiding means may be moved to a predetermined position with respect to the wire insertion opening prior to a crimping operation of the crimping means.

According to the present invention, at a timing different from a timing of the crimping operation of the crimping means arranged adjacent to the guiding means, that is, prior to that where the crimping section is crimped by the crimping means, the wire tip which is guided to the wire insertion opening by the guiding means which is moved to the predetermined position can be inserted into the crimping section. Accordingly, the crimping section can be crimped in a well-organized manner.

As another mode of the present invention, the guiding means may be mounted in the wire insertion opening prior to a crimping operation of the crimping means.

According to the present invention, at a timing different from a timing of the crimping operation of the crimping means, that is, prior to that where the crimping section is crimped by the crimping means, the wire tip which is guided to the wire insertion opening by the guiding means mounted at a predetermined position with respect to the wire insertion opening can be inserted into the crimping section. Accordingly, the crimping section can be crimped in a well-organized manner.

As another mode of the present invention, the wire crimping method may further include: a carrier cutting step of separating a plurality of crimp terminals from a carrier of a terminal connection strip, the carrier formed in a strip-shape, the terminal connection strip formed by connecting the plurality of crimp terminals to the carrier via connecting portions at predetermined intervals in a long length direction of the carrier by shearing the connecting portions by a carrier cutting means in a thickness direction of the carrier, wherein the wire insertion step may be performed such that the wire tip is guided to the wire insertion opening by the guiding means which is disposed at a position in the carrier cutting means which is made to slide to the cutting position, the position corresponding to the wire insertion opening.

According to the present invention, in the operation of the carrier cutting step of separating the crimp terminal and the carrier from each other by cutting the connecting portions, the guiding means is arranged at the predetermined position with respect to the wire insertion opening. Accordingly, the number of operations of the wire crimping device for crimping the crimping section is decreased and hence, the crimping section can be efficiently crimped.

As another mode of the present invention, the wire crimping method may further include a wire gripping step of gripping the wire tip by a guiding and gripping means at the time of guiding the wire tip to the wire insertion opening, wherein at least one of the insulated wire gripped by the guiding and gripping means and the guiding and gripping means may be moved toward the crimping section in the terminal axis direction in the wire insertion step.

According to the present invention, at least one of the insulated wire gripped by the guiding and gripping means and the guiding and gripping means is moved in the terminal axis direction toward the crimping section by the moving means. Accordingly, the wire tip in a state where the wire tip is gripped by the guiding and gripping means is guided to the wire insertion opening so that the wire tip can be smoothly inserted into the crimping section.

Effects of the Invention

According to the present invention, it is possible to provide a wire crimping device and a wire crimping method which can surely and efficiently perform crimping by smoothly inserting a wire tip into a hollow crimping section of a closed-barrel-type crimp terminal.

EMBODIMENTS OF THE INVENTION

One embodiment of the present invention is described by reference to drawings.

First Embodiment

First, the constitution of a female crimp terminal 100, an insulated wire 200 and a crimp-terminal-equipped electric wire 1 according to a first embodiment is described by reference to FIGS. 1A and 1B.

Figure 1A:
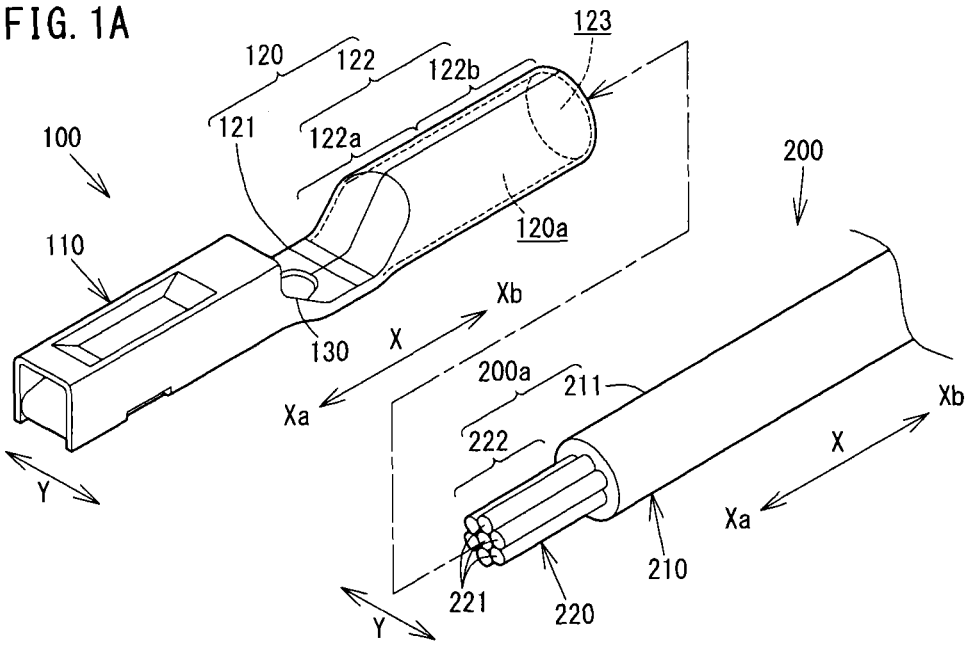
FIGS. 1A and 1B are explanatory views for describing a female crimp terminal, an insulated wire, and a crimp-terminal-equipped electric wire.
Figure 1B:
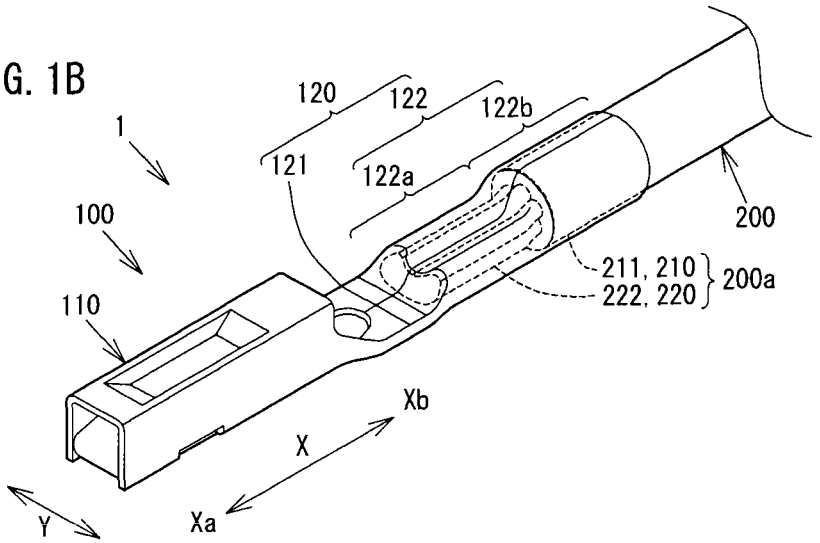

As shown in FIGS. 1A and 1B, the female crimp terminal 100 is connected by crimping to the insulated wire 200 thus forming the crimp-terminal-equipped electric wire 1.

FIG. 1A is a perspective view of the female crimp terminal 100 and the insulated wire 200, and FIG. 1B is a perspective view of the crimp-terminal-equipped electric wire 1 in a post-crimping state.

Further, with respect to the long length direction X of the female crimp terminal 100, a side on which a terminal of the crimp-terminal-equipped electric wire 1 is arranged is assumed as a distal end side Xa, and a side opposite to the terminal side, that is, a side on which the insulated wire 200 is arranged is assumed as a proximal end side Xb.

As shown in FIG. 1A, the insulated wire 200 is formed such that an aluminum lead line 220 formed by binding a plurality of aluminum raw wires 221 made of aluminum, aluminum alloy or the like is covered with an insulating cover 210 made of an insulation resin.

A wire tip 200*a* on the distal end side Xa of the insulated wire 200 is formed of: a conductor exposed portion 222 where the insulating cover 210 on the distal end side Xa of the insulated wire 200 is peeled off by a predetermined length so that the aluminum lead line 220 is exposed; and an insulated cover tip 211 on the distal end side Xa of the insulating cover 210.

By connecting by crimping at least the conductor exposed portion 222 of the wire tip 200*a* having such a constitution and the crimping section 120 to each other, the crimp-terminal-equipped electric wire 1 is formed where the female crimp terminal 100 and the insulated wire 200 can be conductive with each other.

As shown in FIG. 1A, the female crimp terminal 100 includes: a box section 110 which allows the insertion of a male terminal therein; and a crimping section 120 which is connected by crimping to the wire tip 200*a*. The box section 110 on the distal end side Xa and the crimping section 120 on the proximal end side Xb are arranged with a transition section 130 having a predetermined length interposed therebetween.

The box section 110 is formed of a hollow quadrangular columnar body in a laid-down state, and is formed into an approximately rectangular shape as viewed from the distal end side Xa in the long length direction X. The crimping section 120 is formed of a hollow circular columnar body in a laid-down state, and is formed into an approximately circular shape as viewed from the proximal end side Xb in the long length direction X. In this embodiment, the direction which is perpendicular to the long length direction X of a bottom surface of the box section 110 in plane is assumed as the width direction Y.

In the crimping section 120, a sealing portion 121 and a crimping section body 122 are arranged in this order from the distal end side Xa to the proximal end side Xb in the long length direction X. The crimping section 120 is formed as a continuous integral body over the whole circumference.

The sealing portion 121 is formed into a flat plate shape by depressing where plate-shaped terminal substrates which constitute the female crimp terminal 100 overlap with each other by deforming a portion of the crimping section 120 on the distal end side Xa from the crimping section body 122.

The crimping section body 122 is formed of: a conductor crimping section 122*a* which corresponds to the conductor exposed portion 222 of the inserted insulated wire 200 when the female crimp terminal 100 and the insulated wire 200 are connected to each other by crimping; and a cover crimping section 122*b* which corresponds to the insulated cover tip 211 of the inserted insulated wire 200 when the female crimp terminal 100 and the insulated wire 200 are connected to each other by crimping. The crimping section body 122 is formed such that an inner diameter of the crimping section body 122 is substantially equal to an outer diameter of the insulated cover tip 211 of the insulated wire 200 or slightly larger than the outer diameter of the insulated cover tip 211, and an inner diameter of the conductor crimping section 122*a* and an inner diameter of the cover crimping section 122*b* are equal to each other.

The crimping section 120 having such a constitution has a hollow shape (cylindrical shape) with only a portion thereof on the proximal end side Xb opened for allowing the insertion of the wire tip 200*a* into an area ranging from the crimping section body 122 to the sealing portion 121 and with a portion thereof on the distal end side Xa and the whole peripheral portion thereof closed. The crimping section 120 has an insertion space 120*a* which allows the insertion of the wire tip 200*a* therein, and a wire insertion opening 123 on the proximal end side Xb.

Further, the female crimp terminal 100 which includes the box section 110 and the crimping section 120 is formed using one plate material as described later. Accordingly, the box section 110, the crimping section 120, and a transition section 130, to be more specific, the sealing portion 121 and the crimping section body 122 which constitute the crimping section 120 have the same plate thickness.

In this embodiment, the insulated wire 200 is formed such that the aluminum lead line 220 formed by binding the plurality of aluminum raw wires 221 is covered with the insulating cover 210 made of an insulation resin. However, the insulated wire 200 may be formed such that the aluminum lead line 220 formed by a single aluminum raw wire 221 is covered with the insulating cover 210.

Further, the insulated wire 200 is not limited to the configuration where the aluminum lead line 220 formed of the aluminum raw wires 221 is covered with the insulating cover 210. For example, the insulated wire 200 may be formed such that a copper lead line formed by binding copper raw wires made of copper or a copper alloy is covered with the insulating cover 210. Further, the insulated wire 200 may be formed such that a different-wire-mixed lead line formed of different kinds of raw wires is prepared where the aluminum raw wires 221 are arranged around copper raw wires and the copper raw wires and the aluminum raw wires 221 are bundled together and, then, the different-wire-mixed lead line is covered with the insulating cover 210. The insulated wire 200 may also be formed such that a different-wire-mixed lead line formed of different kinds of raw wires is prepared where the copper raw wires are arranged around the aluminum raw wires 221 opposite to the above-mentioned case, and the aluminum raw wires 221 and the copper raw wires are bundled together and, then, the different-wire-mixed lead line is covered with the insulating cover 210.

Next, the wire crimping device 10 at the time of connecting by crimping the above-mentioned female crimp terminal 100 and the insulated wire 200 to each other is described by reference to FIG. 2.

Figure 2:
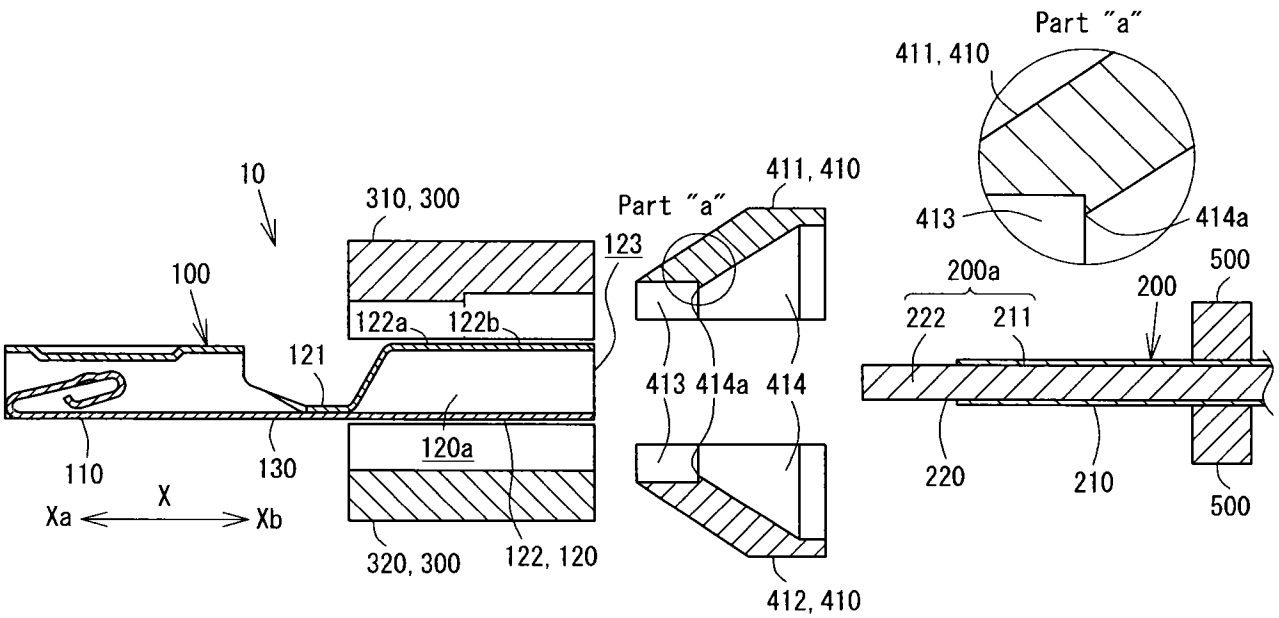
FIG. 2 is a cross-sectional view of a wire crimping device according to a first embodiment.

FIG. 2 is a longitudinal cross-sectional view of the wire crimping device 10 for describing the female crimp terminal 100, the insulated wire 200, and the wire crimping device 10.

As shown in FIG. 2, the wire crimping device 10 is constituted of: a wire crimping unit 300 which connects by crimping the crimping section 120 and the insulated wire 200 to each other; a guiding unit 410 which guides the insertion of the insulated wire 200 into the insertion space 120*a*; and a wire gripping unit 500 which grips the insulated wire 200 and inserts the insulated wire 200 into the crimping section body 122.

The wire crimping unit 300 is constituted of a pressing upper blade (crimper) 310 and a pressing lower blade (anvil) 320 which are formed by vertically splitting a member in two parts. The wire crimping unit 300 is configured to be movable in the vertical direction (the direction where the pressing upper blade 310 and pressing lower blade 320 face each other), and has a function of pressing the crimping section body 122 in the vertical direction by the pressing upper blade 310 and the pressing lower blade 320.

The pressing upper blade 310 and the pressing lower blade 320 are arranged so as to face each other in the vertical direction with a predetermined distance therebetween. Further, the pressing upper blade 310 and the pressing lower blade 320 have, in a state where the pressing upper blade 310 and the pressing lower blade 320 are combined with each other in the vertical direction, inner surface shapes which conform to a profile shape of the crimping section 120 in a state where the female crimp terminal 100 and the insulated wire 200 are crimped to each other.

The guiding unit 410 is configured to be vertically split in two parts, and the split parts are arranged so as to face each other in an opposed manner in the vertical direction in a spaced-apart manner. Further, the guiding unit 410 is arranged on the proximal end side Xb of the wire crimping unit 300 in the long length direction X with a predetermined distance therebetween.

This will be described in more detail. The guiding unit 410 is formed of an upper guiding portion 411 and a lower guiding portion 412 which are formed by vertically splitting a member in two parts. In the state where the upper guiding portion 411 and the lower guiding portion 412 are combined with each other in the vertical direction, the guiding unit 410 is formed into a hollow shape having an inner surface where a guide distal end portion 413 and a guide tapered portion 414 are arranged in this order from the distal end side Xa. The guide distal end portion 413 has a diameter substantially equal to an outer diameter of the crimping section body 122, and extends in the long length direction X. The guide tapered portion 414 has a diameter which is gradually increased toward the proximal end side Xb in the long length direction X from a diameter size substantially equal to an inner diameter of the crimping section body 122.

This will be described in more detail. In a state where the upper guiding portion 411 and the lower guiding portion 412 which constitute the guiding unit 410 are combined with each other in the vertical direction, the guide distal end portion 413 can be mounted on an outer surface of the crimping section body 122. As shown in an enlarged view of part "a" in FIG. 2 and an enlarged view of part "b" in FIG. 3A, the guide tapered portion 414 has a tapered distal end portion 414*a* on the distal end side Xa. The tapered distal end portion 414*a* has an inner diameter which is smaller than a diameter of the guide distal end portion 413 by an amount corresponding to the thickness of the crimping section body 122, and is substantially equal to an inner diameter of the crimping section 120. Provided that the wire tip 200*a* can pass through the tapered distal end portion 414*a*, the tapered distal end portion 414*a* may have a diameter smaller than the inner diameter of the crimping section 120.

Accordingly, the distal end side Xa of the tapered distal end portion 414*a* constitutes a contact surface to which the wire insertion opening 123 of the crimping section 120 is brought into contact.

The guiding unit 410 is configured such that the upper guiding portion 411 and the lower guiding portion 412 are combined with each other by being moved in the long length direction X as well as in the vertical direction from a state where the upper guiding portion 411 and the lower guiding portion 412 are spaced apart from each other in the vertical direction.

With respect to the guiding unit 410, an inner surface of the guide tapered portion 414 is formed of a curved surface having a smooth tapered shape so as to allow the insulated wire 200 to be smoothly inserted into the insertion space 120*a* without being caught by the guide tapered portion 414 when the insulated wire 200 is guided to the insertion space 120*a*.

The wire gripping unit 500 is arranged on the proximal end side Xb of the guiding unit 410 in the long length direction X, and is movable in the long length direction X.

The wire gripping unit 500 has a diameter size that the insulated wire 200 is not movable relative to the wire gripping unit 500 in a state where the wire gripping unit 500 grips a predetermined position of the insulated wire 200.

The wire crimping unit 300, the guiding unit 410 and the wire gripping unit 500 are not operated in an interlocking manner, and constitute independently operable mechanisms.

Subsequently, a wire crimping method for forming the crimp-terminal-equipped electric wire 1 by connecting the above-mentioned female crimp terminal 100 and insulated wire 200 to each other by crimping is described by reference to FIG. 3A to FIG. 4B.

Figure 3A:
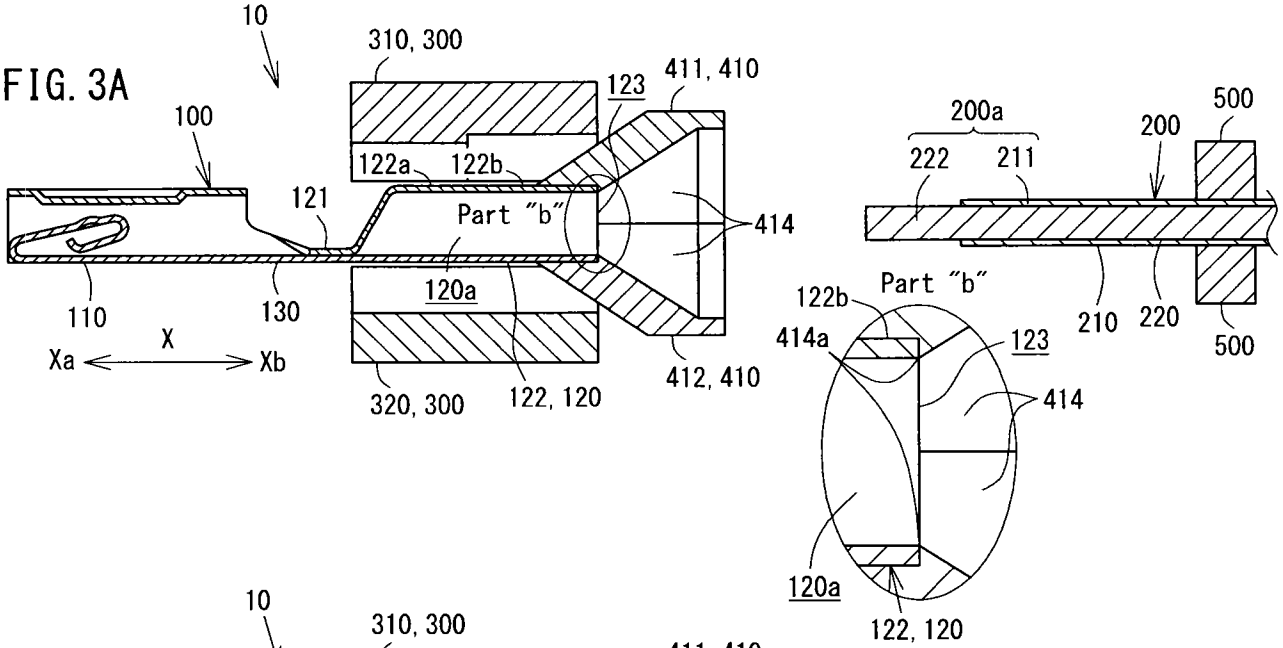
FIGS. 3A and 3B are explanatory views for describing a guide mounting step and a wire insertion step according to the first embodiment.
Figure 3B:
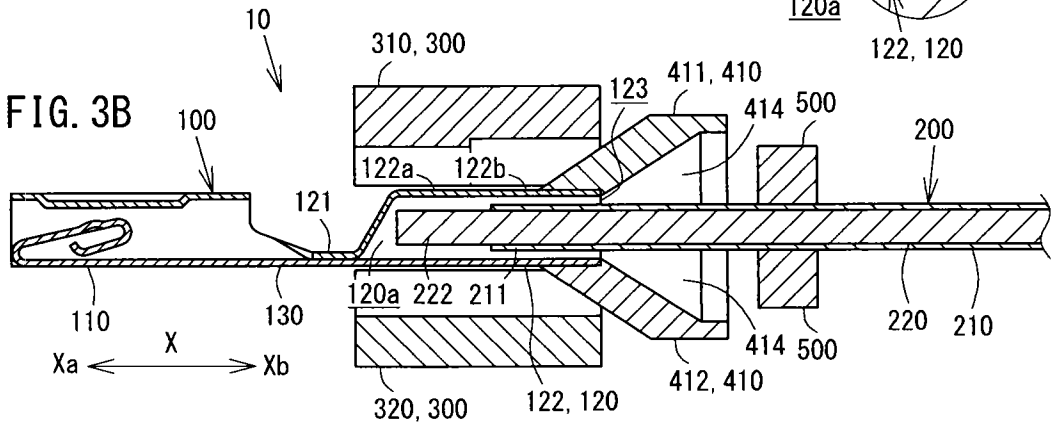
Figure 4A:
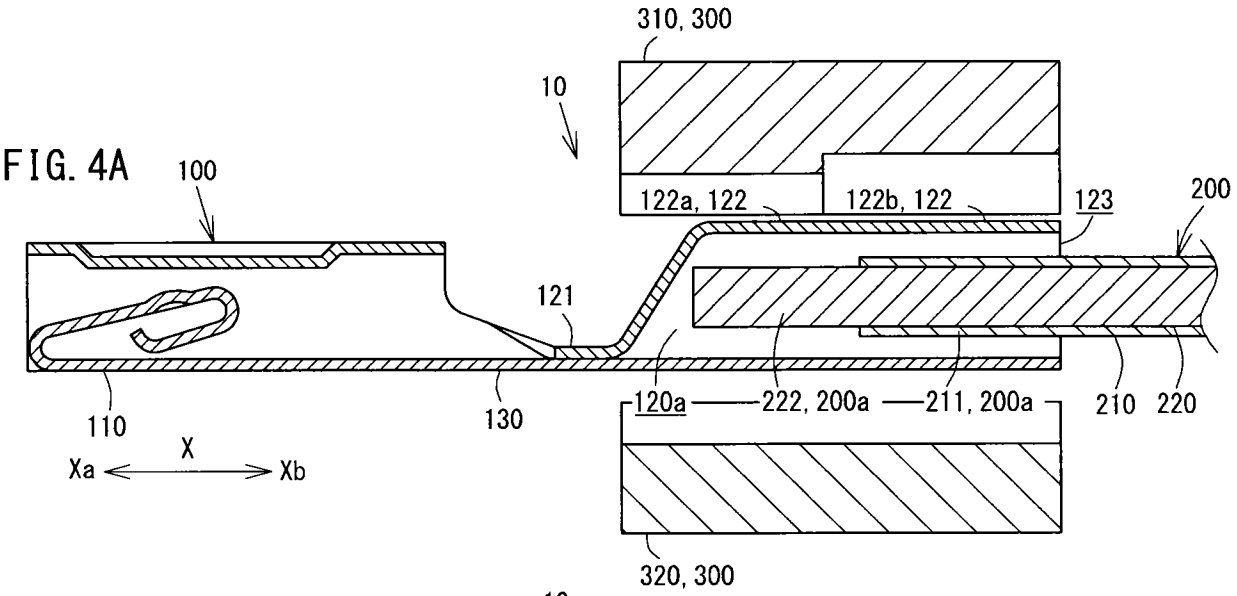
FIGS. 4A and 4B are explanatory views for describing a crimping connection step of connecting the female crimp terminal and the insulated wire to each other by crimping.
Figure 4B:
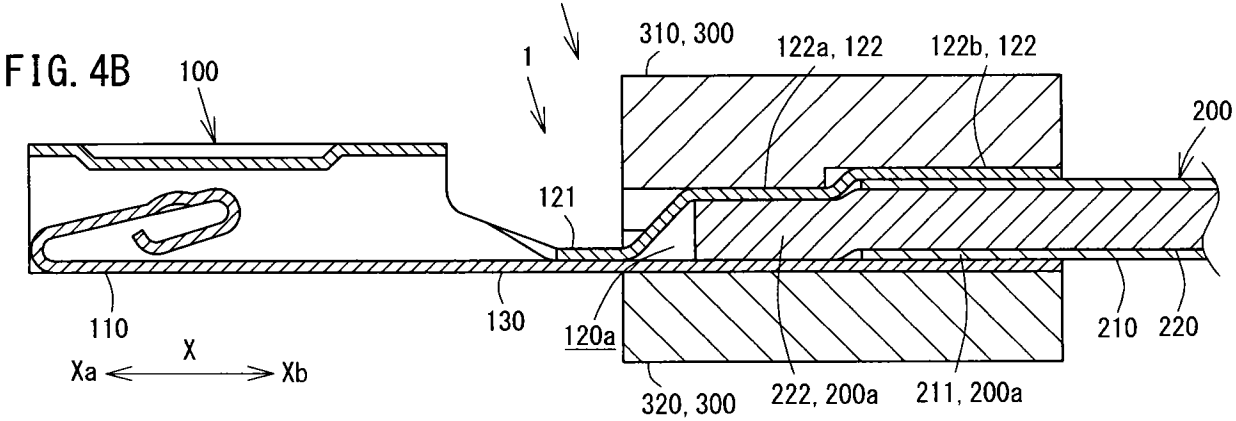

FIG. 3A is a longitudinal cross-sectional view of the wire crimping device 10 for describing a state in a guide mounting step of mounting the guiding unit 410 on the crimping section 120. FIG. 3B is a longitudinal cross-sectional view of the wire crimping device 10 for describing a state in a wire insertion step of inserting the wire tip 200*a* into the insertion space 120*a*. FIG. 4A is a longitudinal cross-sectional view of the wire crimping device 10 for describing a state before a crimping connection step of connecting the crimping section 120 and the wire tip 200*a* to each other by crimping. FIG. 4B is a longitudinal cross-sectional view of the wire crimping device 10 for describing a state after the crimping connection step of connecting the crimping section 120 and the wire tip 200*a* to each other by crimping.

In the wire crimping method, the guide mounting step of mounting the guiding unit 410 on the female crimp terminal 100, the wire insertion step of inserting the wire tip 200*a* into the insertion space 120*a*, and the crimping connection step of connecting the female crimp terminal 100 and the insulated wire 200 to each other by crimping are performed in this order.

First, as shown in FIG. 3A, when the female crimp terminal 100 is arranged at a predetermined position, the wire crimping device 10 starts the guide mounting step.

This will be described in more detail. In a state where the upper guiding portion 411 and the lower guiding portion 412 are combined with each other by moving the upper guiding portion 411 and the lower guiding portion 412 in the long length direction X as well as in the vertical direction, the wire crimping device 10 mounts the guiding unit 410 on the female crimp terminal 100 in such a manner that the guide distal end portion 413 of the guiding unit 410 is inserted into a portion of the crimping section body 122 on the proximal end side Xb.

When the guiding unit 410 is mounted on the female crimp terminal 100, as shown in FIG. 3B, the wire crimping device 10 starts the wire insertion step.

This will be described in more detail. The wire crimping device 10 moves the wire gripping unit 500 gripping the predetermined portion of the insulated wire 200 to the distal end side Xa in the long length direction X by a predetermined distance. At this point of time, the wire crimping device 10 makes the wire tip 200*a* of the insulated wire 200 pass through the guiding unit 410 and the wire insertion opening 123 in this order thus inserting the wire tip 200*a* of the insulated wire 200 into the insertion space 120*a* of the crimping section 120 of the female crimp terminal 100.

When the center of the insulated wire 200 in the radial direction is deviated from the center of the crimping section 120 in the radial direction, the wire tip 220*a* is guided along the inner surface of the guiding unit 410, that is, along the guide tapered portion 414, and is inserted into the insertion space 120*a* of the crimping section 120.

Thereafter, the wire crimping device 10 moves the guiding unit 410 in the long length direction X as well as in the vertical direction for making the guiding unit 410 away from the female crimp terminal 100, and returns the guiding unit 410 to an initial position.

When the insulated wire 200 is inserted into the female crimp terminal 100 and the guiding unit 410 is returned to the initial position, as shown in FIGS. 4A and 4B, the wire crimping device 10 starts the crimping connection step.

This will be described in more detail. The wire crimping device 10 moves the pressing upper blade 310 and the pressing lower blade 320 of the wire crimping unit 300 toward the crimping section 120 of the female crimp terminal 100 into which the wire tip 200*a* of the insulated wire 200 is inserted such that the crimping section 120 is clamped by the pressing upper blade 310 and the pressing lower blade 320 in the vertical direction. Then, the crimping section 120 is pressed by the pressing upper blade 310 and the pressing lower blade 320 so that the crimping section 120 is plastically deformed whereby the crimping section 120 is connected to the wire tip 200*a* by crimping.

When the crimping section 120 and the wire tip 200*a* are connected to each other by crimping, the wire crimping device 10 moves the wire crimping unit 300 and the wire gripping unit 500 in the long length direction X as well as in the vertical direction for making the wire crimping unit 300 and the wire gripping unit 500 away from the female crimp terminal 100, and returns the wire crimping unit 300 and the wire gripping unit 500 to initial positions.

Subsequently, the manner of operation and advantageous effects of the above-mentioned wire crimping device 10 and the manner of operation and advantageous effects of the above-mentioned wire crimping method are described.

With respect to the wire crimping device 10, the guiding unit 410 adopts the split structure, and the guiding unit 410 is mounted on a portion of the crimping section 120 on the proximal end side Xb and hence, the wire tip 200*a* can be easily inserted into the insertion space 120*a*.

This will be described in more detail. As described above, the guiding unit 410 is formed of: the guide distal end portion 413 which can be mounted on a portion of the crimping section 120 on the proximal end side Xb; the guide tapered portion 414 formed of a smooth curved surface having a tapered shape; and the tapered distal end portion 414*a* constituting a distal end portion of the guide tapered portion 414.

In a state where the upper guiding portion 411 and the lower guiding portion 412 of the guiding unit 410 are combined with each other, the guide distal end portion 413 can be mounted on the proximal end side Xb of the crimping section 120 such that the tapered distal end portion 414*a* is brought into contact with an edge portion of the wire insertion opening 123 of the crimping section 120.

Due to such a constitution, the guiding unit 410 is accurately positioned with respect to the female crimp terminal 100 so that the wire tip 200*a* can be surely inserted into the insertion space 120*a*.

Further, the tapered distal end portions 414*a* having an inner diameter substantially equal to the inner diameter of the crimping section 120 are brought into contact with the edge of the wire insertion opening 123 and hence, the guiding unit 410 can cover the edge of the wire insertion opening 123.

Due to such a constitution, there is no possibility that the edge of the wire insertion opening 123 projects inwardly from the tapered distal end portions 414*a* at boundaries between the guide tapered portions 414 and the wire insertion opening 123 and hence, the wire crimping device 10 can surely guide the wire tip 200*a* to the inside of the insertion space 120*a*.

Accordingly, with respect to the wire crimping device 10, a position of the guiding unit 410 can be accurately fixed with respect to the female crimp terminal 100 by the guide distal end portion 413, and the wire tip 200*a* can be smoothly and surely inserted into the insertion space 120*a* by the guide tapered portions 414 and the tapered distal end portions 414*a* without being caught by the inner surface of the guide tapered portions 414 or the edge portion of the wire insertion opening 123.

Further, with respect to the wire crimping device 10, the guiding unit 410 adopts the split structure and hence, the upper guiding portion 411 and the lower guiding portion 412 of the guiding unit 410 can be made spaced-apart from each other. Accordingly, the wire crimping device 10 can easily return the guiding unit 410 to the initial position from the insulated wire 200 inserted into the female crimp terminal 100 after the wire insertion step.

The guiding unit 410 may be a part of the mechanism of the wire crimping device 10, or may be a separate part independent from the wire crimping device 10.

The wire crimping unit 300, the guiding unit 410, and the wire gripping unit 500 are not limited to the independent mechanisms which are not operated in an interlocking manner. For example, the mechanism may be adopted where the guiding unit 410 and the wire gripping unit 500 are operated in an interlocking manner with the vertical movement of the wire crimping unit 300 as shown in FIG. 17A to FIG. 18C using cams or link mechanisms not shown in the drawings.

Figure 17A:
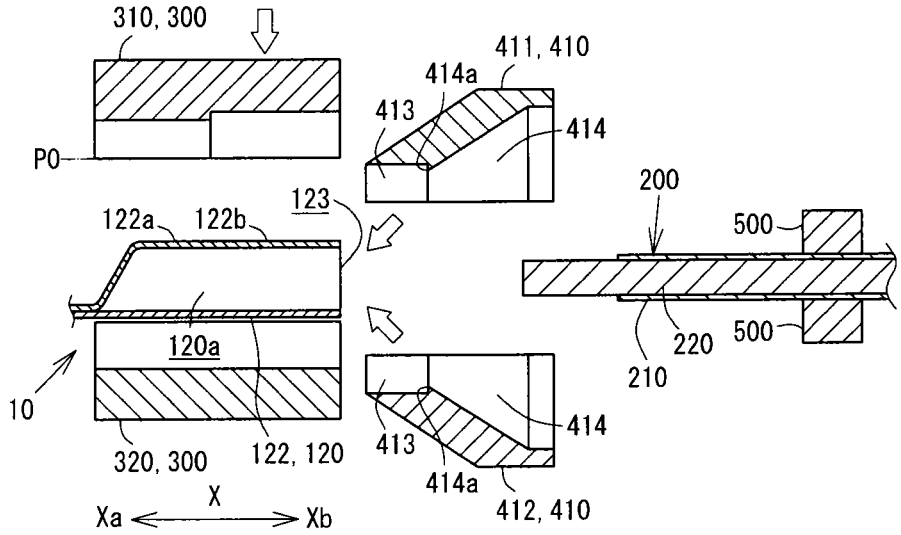
FIGS. 17A and 17B are cross-sectional views for describing the movement of a wire crimping unit, a guiding unit and a wire gripping unit according to another embodiment.
Figure 17B:
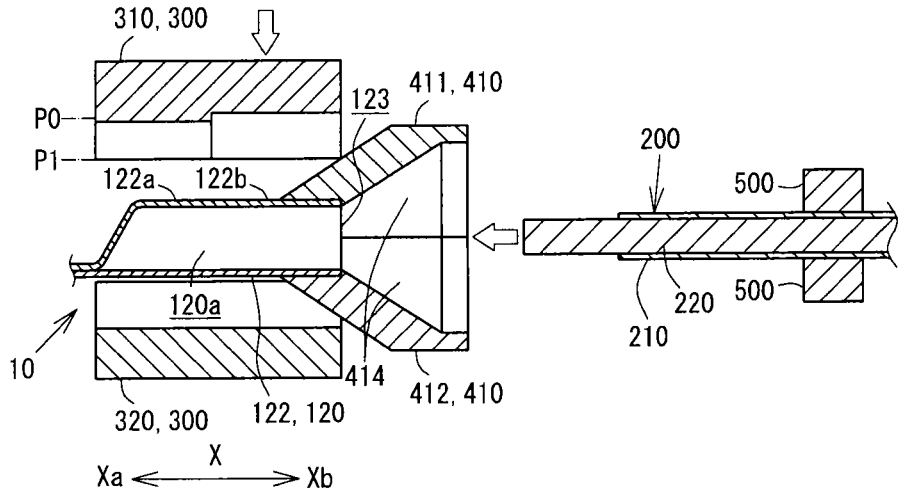

FIG. 17A is a longitudinal cross-sectional view of the wire crimping device 10 for describing a state before the guide mounting step, and FIG. 17B is a longitudinal cross-sectional view of the wire crimping device 10 for describing the manner of operation after the guide mounting step.

Figure 18A:
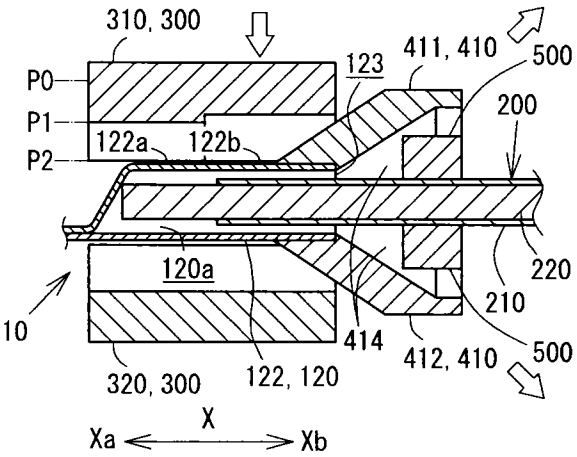
FIGS. 18A to 18C are cross-sectional views for describing the movement of a wire crimping unit, a guiding unit and a wire gripping unit according to another embodiment.
Figure 18B:
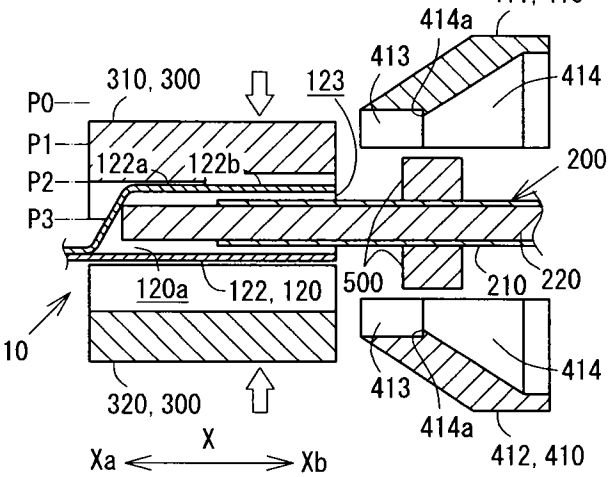
Figure 18C:
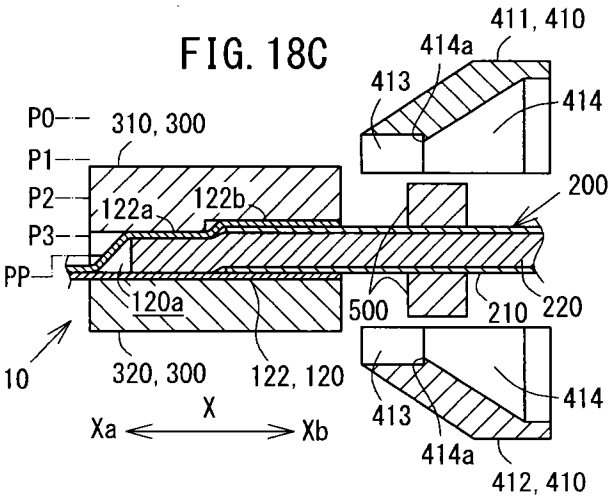

FIG. 18A is a longitudinal cross-sectional view of the wire crimping device 10 for describing a state in the midst of the wire insertion step, FIG. 18B is a longitudinal cross-sectional view of the wire crimping device 10 for describing a state after the wire insertion step, and FIG. 18C is a longitudinal cross-sectional view of the wire crimping device 10 for describing a state after the crimping connection step.

As shown in FIG. 17A, the wire crimping device 10 arranges the wire crimping unit 300, the guiding unit 410 and the wire gripping unit 500 at initial positions.

Next, as shown in FIG. 17B, when the pressing upper blade 310 is moved from a crimping unit initial position P0 to a first intermediate position P1, the wire crimping device 10 moves the guiding unit 410 to a position where the guide distal end portions 413 are mounted on the proximal end side Xb of the crimping section body 122 as described above.

Then, as shown in FIG. 18A, when the pressing upper blade 310 is moved from the first intermediate position P1 to a second intermediate position P2, the wire crimping device 10 inserts the wire tip 200*a* of the insulated wire 200 into the insertion space 120*a* of the crimping section 120 as described previously.

Then, as shown in FIG. 18B, when the pressing upper blade 310 is moved from the second intermediate position P2 to a third intermediate position P3, the wire crimping device 10 returns the guiding unit 410 to the initial position as described above.

Subsequently, as shown in FIG. 18C, the wire crimping device 10 moves the pressing upper blade 310 to a crimping position PP where the crimping section body 122 and the insulated wire 200 are crimped to each other and, at the same time, the wire crimping device 10 moves the pressing lower blade 320 to the crimping position PP.

Finally, as shown in FIG. 17A, the wire crimping device 10 returns the wire crimping unit 300 and the wire gripping unit 500 to the initial positions.

In this manner, the guiding unit 410 and the wire gripping unit 500 are operated in an interlocking manner with the vertical movement of the wire crimping unit 300 and hence, the guide mounting step, the wire insertion step, and the crimping connection step can be smoothly performed.

Second Embodiment

A female crimp terminal 100, a wire crimping device 10 and a wire crimping method according to another embodiment are described.

First, the constitution of the wire crimping device 10 and the constitution of the female crimp terminal 100 at the time of connecting the female crimp terminal 100 and an insulated wire 200 to each other by crimping are described by reference to FIG. 5 and FIGS. 6A and 6B.

Figure 5:
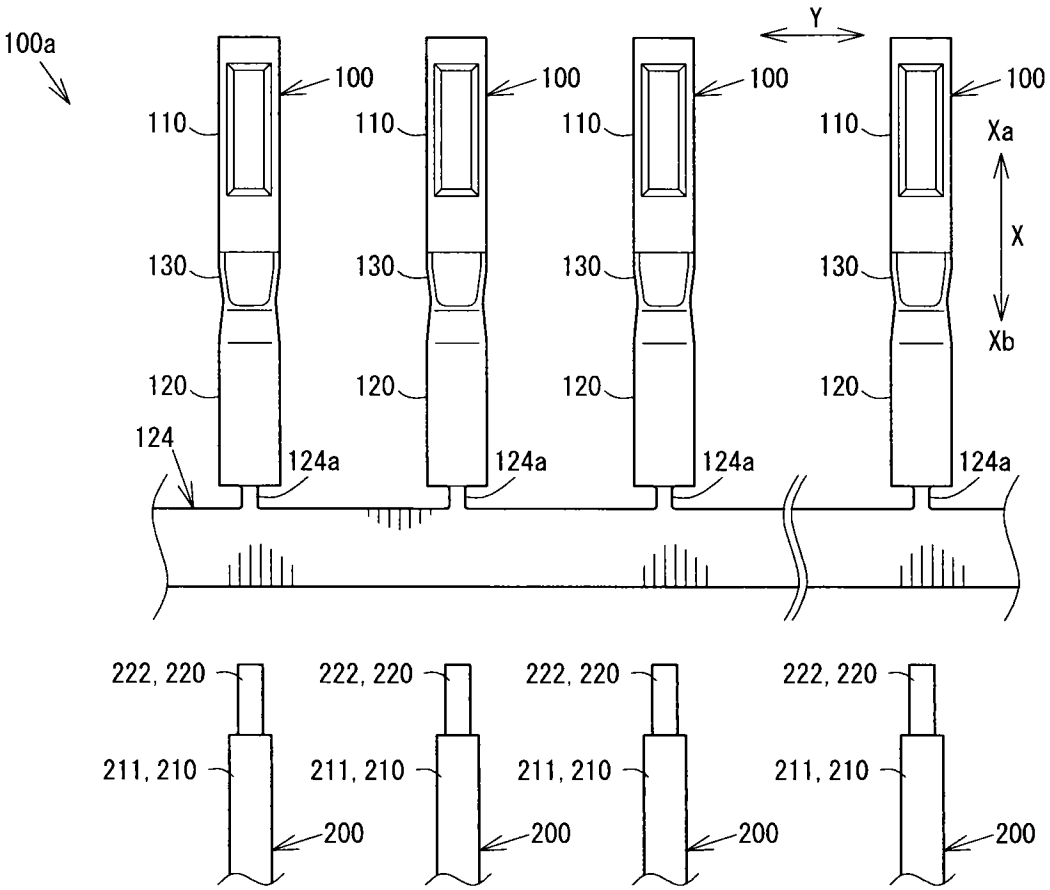
FIG. 5 is a plan view for describing a terminal connection strip according to a second embodiment.
Figure 6A:
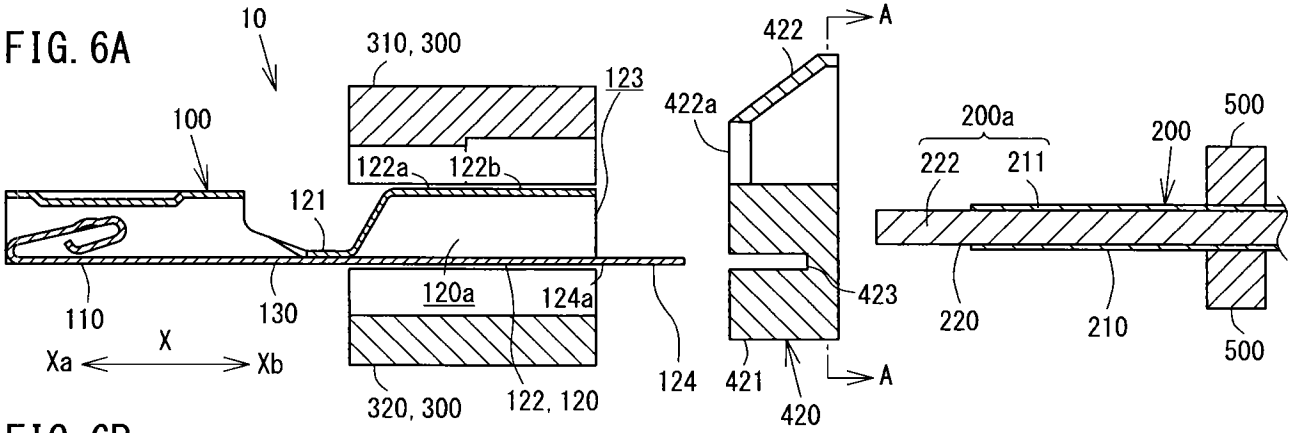
FIGS. 6A and 6B are explanatory views of a wire crimping device according to the second embodiment.
Figure 6B:
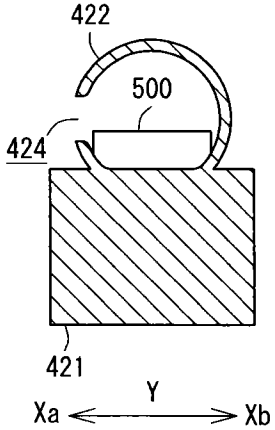

FIG. 5 is a plan view of a terminal connection strip 100*a* and the insulated wires 200, FIG. 6A is a longitudinal cross-sectional view of the wire crimping device 10 for describing the female crimp terminal 100, the insulated wire 200 and the wire crimping device 10, and FIG. 6B is a cross-sectional view taken along line A-A in FIG. 6A. To facilitate the understanding of the respective constitutions, an end surface of the wire crimping unit 300 on a proximal end side Xb and an end surface of a guiding and cutting unit 420 on a distal end side Xa are spaced apart from each other in FIG. 6A. However, the end surface of the wire crimping unit 300 on the proximal end side Xb and the end surface of the guiding and cutting unit 420 on the distal end side Xa are in contact with each other in a slidable manner in an actual device.

The constitutions equal to the corresponding constitutions of the above-mentioned first embodiment are given the same symbols, and the detailed explanation of such constitutions is omitted.

The terminal connection strip 100*a* is configured such that a plurality of female crimp terminals 100 are connected to an approximately strip-shaped carrier 124 having the long length direction thereof directed in the width direction Y of the female crimp terminal 100.

This will be described in more detail. The terminal connection strip 100*a* is configured as follows. As shown in FIG. 5, in a plan view, a rear portion of a crimping section 120 of each female crimp terminal 100 is connected to the carrier 124 by way of a connecting portion 124*a* such that the long length direction X of the female crimp terminal 100 substantially agrees with the short length direction of the carrier 124 which is orthogonal to the long length direction of the carrier 124. Further, the plurality of female crimp terminals 100 are connected to the carrier 124 such that the female crimp terminals 100 are arranged in a spaced-apart manner in the long length direction of the carrier 124, that is, in the width direction Y.

Such a terminal connection strip 100*a* is configured as follows. A base material having an approximately flat-plate shape is blanked out into a substrate where an approximately strip-shaped carrier 124 and portions of a shape of a terminal developed in plane are connected to each other, and the terminal shaped portions are formed by bending into stereoscopic terminal shapes thus providing a state where the plurality of female crimp terminals 100 are connected to the carrier 124.

As shown in FIG. 6A, the wire crimping device 10 is constituted of a wire crimping unit 300; a guiding and cutting unit 420 which guides the insertion of the insulated wire 200 into a crimping section 120 and separates the female crimp terminal 100 and the carrier 124 from each other; and a wire gripping unit 500.

The guiding and cutting unit 420 is arranged on a portion of the wire crimping unit 300 on a proximal end side Xb in the long length direction X and is movable in the vertical direction.

This will be described in more detail. The guiding and cutting unit 420 is formed of an integral body constituted of: a carrier cutting portion 421 which separates the female crimp terminal 100 and the carrier 124 from each other; and a guiding portion 422 which guides the insertion of the insulated wire 200 into a crimping section body 122.

The carrier cutting portion 421 is formed into a shape which has an approximately rectangular cross section, and has a sandwiching portion 423 into which the carrier 124 is inserted.

As shown in FIG. 6B, the guiding portion 422 is integrally formed with the carrier cutting portion 421 such that the guiding portion 422 is mounted on the carrier cutting portion 421. The guiding portion 422 has an approximately C-shaped cross section as viewed in the long length direction X.

This will be described in more detail. The guiding portion 422 is formed to have a hollow portion having a tapered inner surface shape substantially equal to the shape of the inner surface of the guide tapered portion 414 of the guiding unit 410 of the above-mentioned first embodiment. Further, one side surface of the guiding portion 422 in the width direction Y is opened along the long length direction X so that the guiding portion 422 has an opening portion 424 which allows the insertion of the insulated wire 200 therein. A guide opening portion 422*a* is formed in a portion of the guiding portion 422 on a distal end side Xa with an opening diameter substantially equal to an inner diameter of the crimping section 120. The guiding portion 422 is formed integrally with the carrier cutting portion 421 such that a lower side of the guiding portion 422 is arranged on an upper surface of the carrier cutting portion 421.

The guiding and cutting unit 420 is movable in the vertical direction from an initial position where the sandwiching portion 423 of the carrier cutting portion 421 stands by on a traffic line of the carrier 124 in the long length direction of the carrier 124 of the terminal connection strip 100*a*, that is, in the width direction Y to a position where the distal end side Xa of the guiding portion 422 faces the wire insertion opening 123 of the crimping section 120 in the long length direction X.

Subsequently, a wire crimping method for forming a crimp-terminal-equipped electric wire 1 by connecting the above-mentioned female crimp terminal 100 and insulated wire 200 to each other by crimping is described by reference to FIGS. 4A and 4B, FIGS. 7A and 7B and FIG. 8.

Figure 7A:
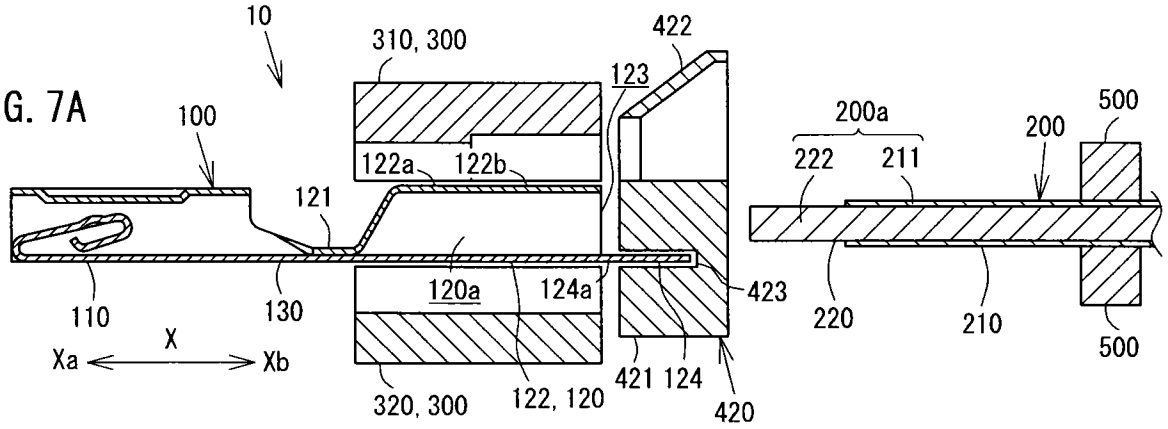
FIGS. 7A and 7B are explanatory views for describing a carrier cutting step according to the second embodiment.
Figure 7B:
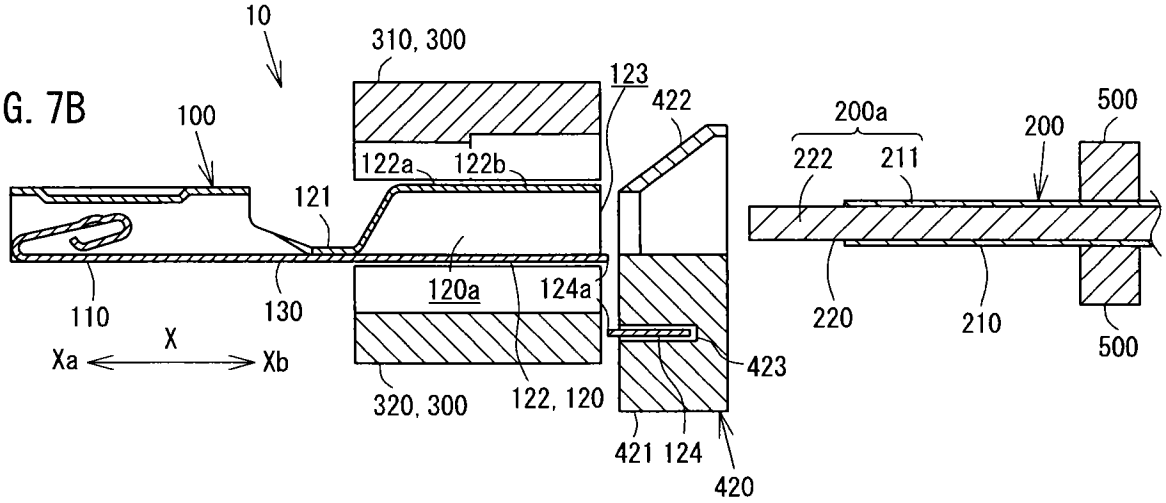
Figure 8:
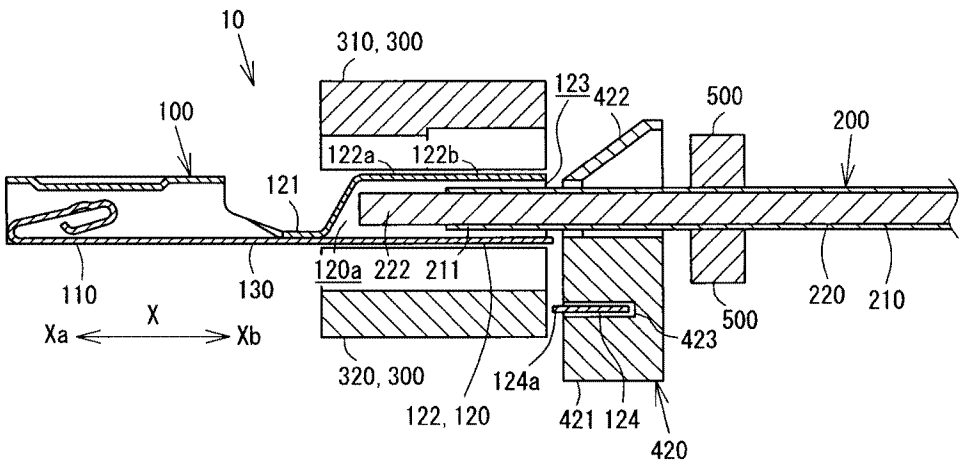
FIG. 8 is a cross-sectional view describing a wire insertion step according to the second embodiment.

FIG. 7A is a longitudinal cross-sectional view of the wire crimping device 10 for describing a state in the midst of a carrier cutting step of separating the female crimp terminal 100 and the carrier 124 from each other by the guiding and cutting unit 420, FIG. 7B is a longitudinal cross-sectional view of the wire crimping device 10 for describing a state at the time where a carrier cutting step of separating the female crimp terminal 100 and the carrier 124 from each other by the guiding and cutting unit 420 is finished, and FIG. 8 is a longitudinal cross-sectional view of the wire crimping device 10 for describing a state in a wire insertion step of inserting the wire tip 200*a* into the insertion space 120*a*.

To facilitate the understanding of the respective constitutions, an end surface of the wire crimping unit 300 on a proximal end side Xb and an end surface of a guiding and cutting unit 420 on a distal end side Xa are slightly spaced apart from each other in FIGS. 7A and 7B and FIG. 8. However, the end surface of the wire crimping unit 300 on the proximal end side Xb and the end surface of the guiding and cutting unit 420 on the distal end side Xa are in contact with each other in a slidable manner in an actual device.

In the wire crimping method, the carrier cutting step of separating the female crimp terminal 100 and the carrier 124 from each other, the wire insertion step and the crimping connection step are performed in this order.

First, the wire crimping device 10 starts the carrier cutting step when the female crimp terminal 100 is arranged at a predetermined position.

This will be described in more detail. As shown in FIG. 7A, the wire crimping device 10 inserts the carrier 124 of the terminal connection strip 100*a* into the sandwiching portion 423 of the guiding and cutting unit 420 arranged at an initial position.

Thereafter, as shown in FIG. 7B, the wire crimping device 10 moves the guiding and cutting unit 420 in the downward direction up to a position where a distal end side Xa of the guiding portion 422 of the guiding and cutting unit 420 faces the wire insertion opening 123 of the crimping section 120 in the long length direction X. At the same time, the carrier cutting portion 421 separates the female crimp terminal 100 from the terminal connection strip 100*a* by cutting the carrier 124 by shearing using the sandwiching portion 423.

When the female crimp terminal 100 is separated from the terminal connection strip 100*a*, as shown in FIG. 8, the wire crimping device 10 starts the wire insertion step.

This will be described in more detail. The wire crimping device 10 moves the wire gripping unit 500 gripping the predetermined position of the insulated wire 200 to the distal end side Xa in the long length direction X by a predetermined distance. At this point of time, the wire crimping device 10 makes the wire tip 200*a* of the insulated wire 200 pass through the guide opening portion 422*a* of the guiding portion 422 and the wire insertion opening 123 in this order thus inserting the wire tip 200*a* of the insulated wire 200 into the insertion space 120*a* of the crimping section 120 of the female crimp terminal 100.

When the center of the insulated wire 200 in the radial direction is deviated from the center of the crimping section 120 in the radial direction, the wire tip 220*a* is guided along the inner surface of the guiding and cutting unit 420, and is inserted into the insertion space 120*a* of the crimping section 120.

When the insulated wire 200 is inserted into the female crimp terminal 100, as shown in FIGS. 4A and 4B, the wire crimping device 10 starts the crimping connection step.

This will be described in more detail. The wire crimping device 10 moves a pressing upper blade 310 and a pressing lower blade 320 of the wire crimping unit 300 toward the crimping section 120 of the female crimp terminal 100 into which the wire tip 200*a* of the insulated wire 200 is inserted such that the crimping section 120 is clamped by the pressing upper blade 310 and the pressing lower blade 320 in the vertical direction. Then, the crimping section 120 is pressed by the pressing upper blade 310 and the pressing lower blade 320 so that the crimping section 120 is plastically deformed whereby the crimping section 120 is connected by crimping to the wire tip 200*a*. Thereafter, the wire crimping device 10 moves the crimp-terminal-equipped electric wire 1 in the width direction Y and, at the same time, the crimp-terminal-equipped electric wire 1 is removed from the wire crimping device 10 by making the insulated wire 200 pass through the opening portion 424 of the guiding portion 422.

When the crimping section 120 and the wire tip 200*a* are connected to each other by crimping, the wire crimping device 10 returns the wire crimping unit 300, the guiding and cutting unit 420 and the wire gripping unit 500 to initial positions by moving the wire crimping unit 300, the guiding and cutting unit 420 and the wire gripping unit 500 in the long length direction X as well as in the vertical direction.

Subsequently, the manner of operation and advantageous effects of the above-mentioned wire crimping device 10 and the manner of operation and advantageous effects of the above-mentioned wire crimping method are described.

In the wire crimping device 10, the guiding and cutting unit 420 is formed of an integral body where the guiding portion 422 is mounted on an upper planar surface of the carrier cutting portion 421 so that the carrier cutting step and the wire insertion step can be smoothly performed.

This will be described in more detail. In the carrier cutting step, the wire crimping device 10 moves the guiding and cutting unit 420 in the downward direction from the initial position to a position where the wire insertion opening 123 of the crimping section 120 on the proximal end side Xb faces the distal end side Xa of the guiding portion 422, and holds the guiding portion 422 in such a stand-by state.

Accordingly, after the carrier cutting step is finished, the wire crimping device 10 can immediately insert the wire tip 200*a* into the insertion space 120*a* through the guiding portion 422 of the guiding and cutting unit 420 and hence, the processing can be smoothly shifted to the wire insertion step.

In the wire crimping device 10, the guiding portion 422 has the opening portion 424 which allows the removal of the insulated wire 200 along the long length direction X, that is, the guiding portion 422 is formed into an approximately C shape in cross section as viewed in the long length direction X. Accordingly, after the crimping step is finished, the insulated wire 200 which is connected to the female crimp terminal 100 by crimping can be easily removed through the opening portion 424 of the guiding portion 422.

Further, the wire crimping device 10 includes the guiding and cutting unit 420 formed of the integral body where the lower side of the guiding portion 422 is arranged on the upper surface of the carrier cutting portion 421 (see FIGS. 6A and 6B). Accordingly, compared with a wire crimping device where a guiding portion and a carrier cutting portion are formed as separate bodies, the number of parts can be decreased so that the mechanism of the device can be simplified.

Third Embodiment

A female crimp terminal 100, a wire crimping device 10 and a wire crimping method according to another embodiment are described.

First, the constitution of the wire crimping device 10 at the time of connecting the female crimp terminal 100 and an insulated wire 200 to each other by crimping is described by reference to FIG. 9.

Figure 9:
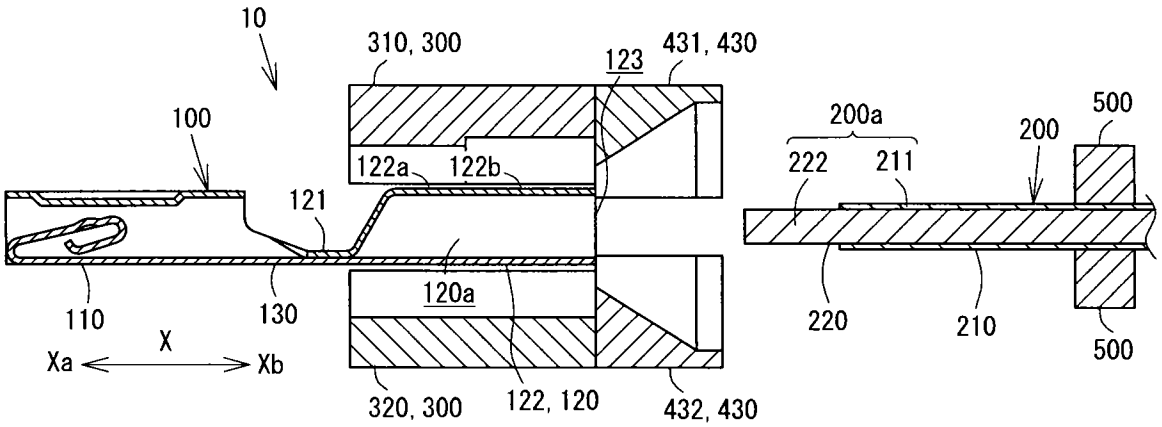
FIG. 9 is a cross-sectional view describing a wire crimping device according to a third embodiment.

FIG. 9 is a longitudinal cross-sectional view of the wire crimping device 10 for describing the female crimp terminal 100, the insulated wire 200 and the wire crimping device 10.

The constitutions equal to the corresponding constitutions of the above-mentioned first embodiment are given the same symbols, and the detailed explanation of such constitutions is omitted.

As shown in FIG. 9, the wire crimping device 10 is constituted of a wire crimping unit 300, a guiding unit 430 and a wire gripping unit 500.

The guiding unit 430 is configured to be vertically split in two parts, and the split parts are arranged so as to face each other in an opposed manner in the vertical direction in a spaced-apart manner. Further, the guiding unit 430 is arranged such that an end surface of the guiding unit 430 on a distal end side Xa is brought into contact with an end surface of the wire crimping unit 300 on a proximal end side Xb.

This will be described in more detail. The guiding unit 430 is formed of an upper guiding portion 431 and a lower guiding portion 432 which are formed by vertically splitting a member in two parts. In a state where the upper guiding portion 431 and the lower guiding portion 432 are combined with each other in the vertical direction, the guiding unit 430 is formed into a hollow shape having a tapered inner surface where a diameter is gradually increased toward the proximal end side Xb from the distal end side Xa from a diameter size substantially equal to an inner diameter of a crimping section body 122.

The guiding unit 430 is configured such that the upper guiding portion 431 and the lower guiding portion 432 are combined with each other by being moved in the vertical direction from a state where the upper guiding portion 431 and the lower guiding portion 432 are spaced apart from each other in the vertical direction.

The wire crimping unit 300 may be operated in an interlocking manner with the vertical movement of the upper guiding portion 431 and the lower guiding portion 432 of the guiding unit 430.

Subsequently, a wire crimping method for forming the crimp-terminal-equipped electric wire 1 by connecting the above-mentioned female crimp terminal 100 and insulated wire 200 to each other by crimping is described by reference to FIG. 10A to FIG. 11B.

Figure 10A:
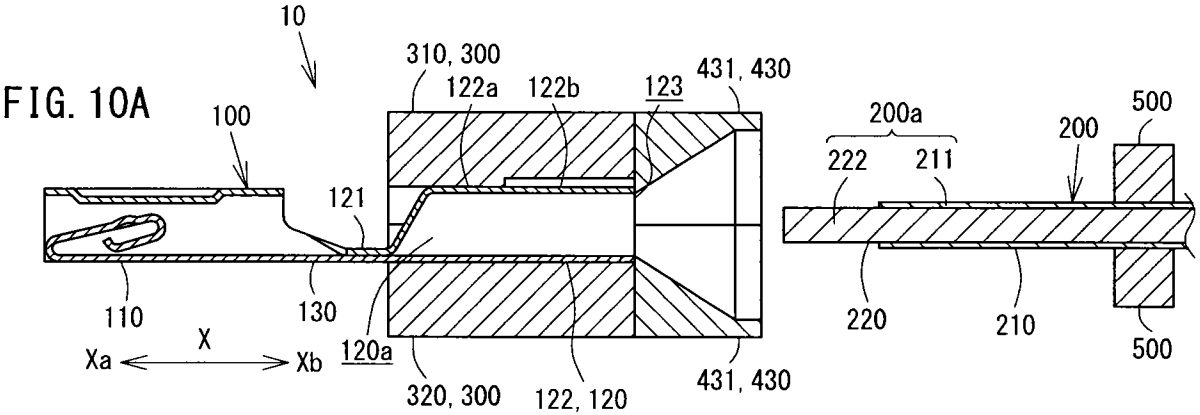
FIGS. 10A and 10B are explanatory views for describing a guide mounting step and a wire insertion step according to the third embodiment.
Figure 10B:
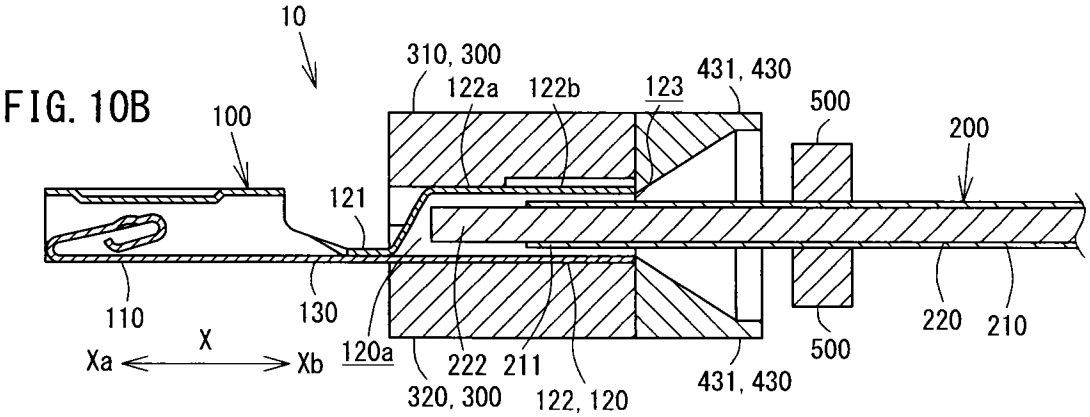
Figures 11A, 11B:
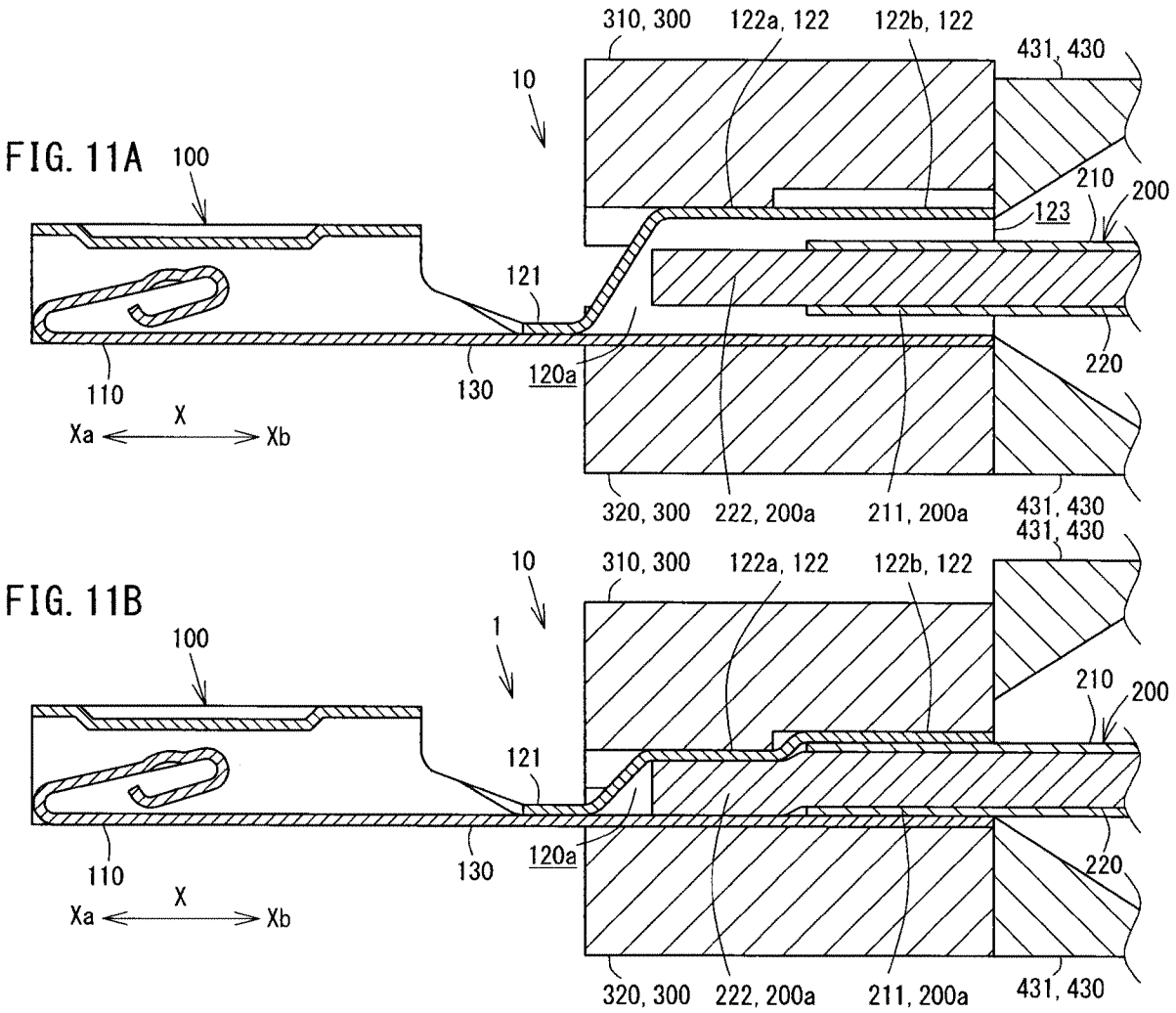
FIGS. 11A and 11B are explanatory views for describing a crimping connection step according to the third embodiment.

FIG. 10A is a longitudinal cross-sectional view of the wire crimping device 10 for describing a state in a guide moving step of moving an inner diameter of the guiding unit 430 to a position which faces an inner diameter of a crimping section 120. FIG. 10B is a longitudinal cross-sectional view of the wire crimping device 10 for describing a state in a wire insertion step of inserting a wire tip 200*a* into an insertion space 120*a*. FIG. 11A is a longitudinal cross-sectional view for describing a state before a crimping connection step of connecting the crimping section 120 and the wire tip 200*a* to each other by crimping. FIG. 11B is a longitudinal cross-sectional view of the wire crimping device 10 for describing a state after the crimping connection step of connecting the crimping section 120 and the wire tip 200*a* to each other by crimping.

In the wire crimping method, the guide moving step, the wire insertion step and the crimping connection step are performed in this order. In the guide moving step, the inner diameter of the guiding unit 430 is moved to the position which faces the inner diameter of the crimping section 120.

First, as shown in FIG. 10A, when the female crimp terminal 100 is arranged at a predetermined position, the wire crimping device 10 starts the guide moving step.

This will be described in more detail. In a state where the upper guiding portion 431 and the lower guiding portion 432 of the guiding unit 430 which are spaced apart from each other in the vertical direction are combined with each other by moving the upper guiding portion 431 and the lower guiding portion 432 in the vertical direction, the wire crimping device 10 arranges the guiding unit 430 such that the inner diameter of the guiding unit 430 on the distal end side Xa faces a wire insertion opening 123 of the crimping section 120. At this point of time, the wire crimping unit 300 also starts the vertical movement thereof.

When the guiding unit 430 is arranged at a predetermined position with respect to the female crimp terminal 100, as shown in FIG. 10B, the wire crimping device 10 starts the wire insertion step.

This will be described in more detail. The wire crimping device 10 moves the wire gripping unit 500 gripping a predetermined position of the insulated wire 200 to the distal end side Xa in the long length direction X by a predetermined distance. At this point of time, the wire crimping device 10 makes the wire tip 200*a* of the insulated wire 200 pass through the guiding unit 430 and the wire insertion opening 123 in this order thus inserting the wire tip 200*a* of the insulated wire 200 into the insertion space 120*a* of the crimping section 120 of the female crimp terminal 100.

When the center of the insulated wire 200 in the radial direction is deviated from the center of the crimping section 120 in the radial direction, the wire tip 220*a* is guided along an inner surface of the guiding unit 430, and is inserted into the insertion space 120*a* of the crimping section 120.

When the insulated wire 200 is inserted into the female crimp terminal 100, as shown in FIGS. 11A and 11B, the wire crimping device 10 starts the crimping connection step.

This will be described in more detail. The wire crimping device 10 further pushes the crimping section 120 of the female crimp terminal 100 into which the wire tip 200*a* of the insulated wire 200 is inserted by further moving the pressing upper blade 310 and the pressing lower blade 320 with respect to the crimping section 120 so that the crimping section 120 is plastically deformed whereby the crimping section 120 is connected to the wire tip 200*a* by crimping.

When the crimping section 120 and the wire tip 200*a* are connected to each other by crimping, the wire crimping device 10 moves the guiding unit 430 in the vertical direction for making the guiding unit 430 away from the female crimp terminal 100, and returns the guiding unit 430 to an initial position.

Subsequently, the manner of operation and advantageous effects of the above-mentioned wire crimping device 10 and the manner of operation and advantageous effects of the above-mentioned wire crimping method are described.

The wire crimping device 10 adopts the constitution where the guiding unit 430 is not mounted on the portion of the crimping section body 122 on the proximal end side Xb so that the guide moving step, the wire insertion step, and the crimping connection step can be smoothly performed.

This will be described in more detail. The wire crimping device 10 adopts the constitution where the guiding unit 430 is not mounted on the crimping section 120 so that the processing can be shifted to the crimping connection step without returning the guiding unit 430 to the initial position between the guide moving step and the wire insertion step.

That is, it is unnecessary for the wire crimping device 10 to mount or dismount the guiding unit 430 before and after the wire insertion step so that the processing can be smoothly shifted in order from the guide moving step, the wire insertion step, and the crimping connection step.

Figure 19A:
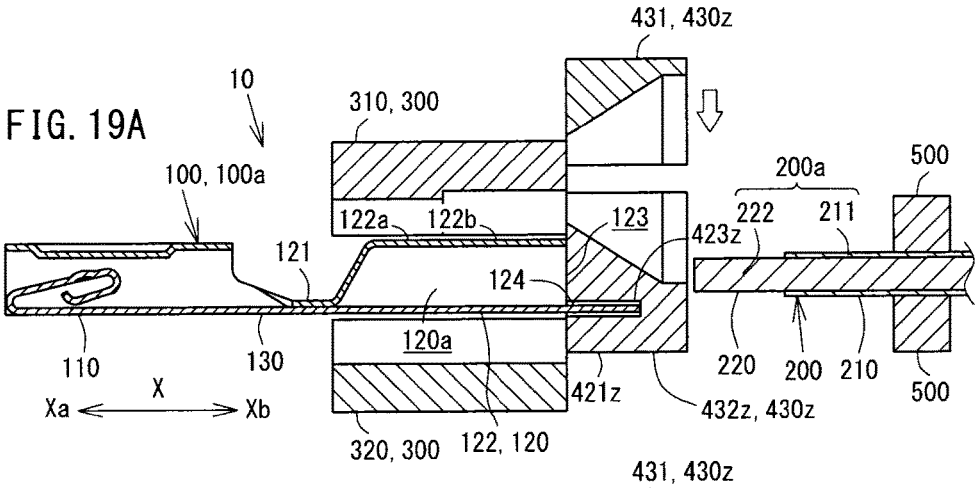
FIGS. 19A to 19C are cross-sectional views for describing a guiding unit according to another embodiment.
Figure 19B:
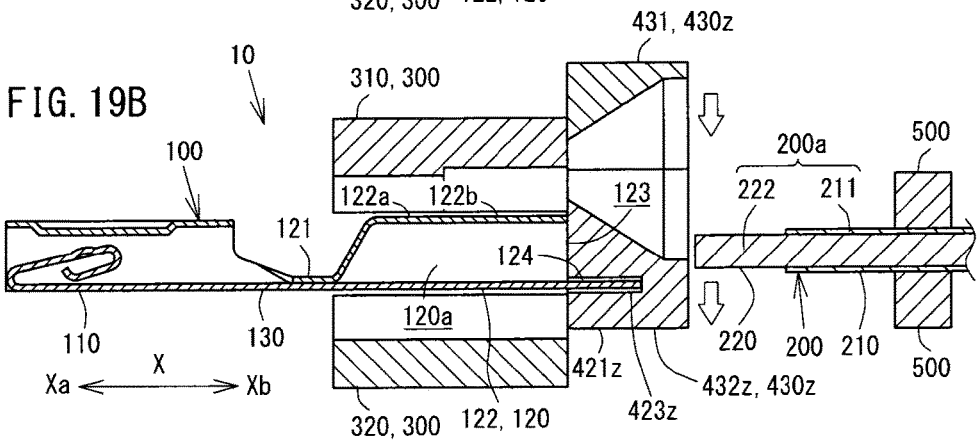
Figure 19C:
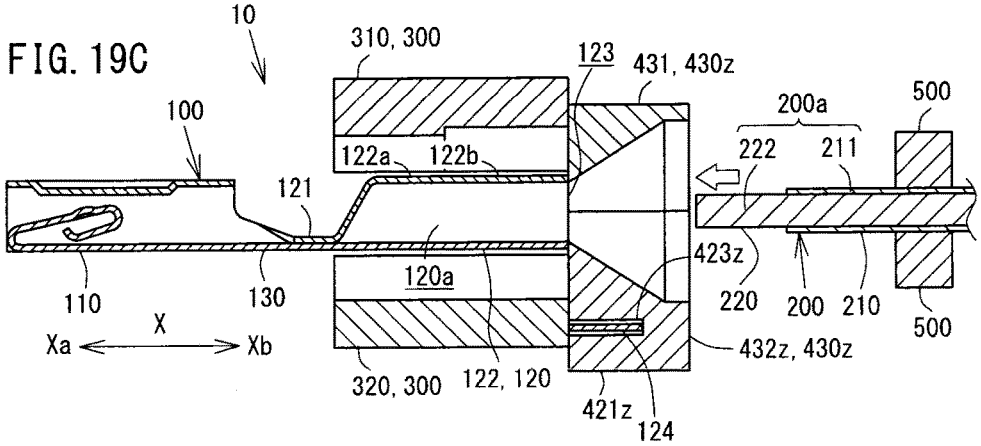

As shown in FIG. 19A to FIG. 19C, the guiding unit of this embodiment may be formed of a guiding unit 430*z* where a carrier cutting portion 421*z* of the guiding and cutting unit in the second embodiment is arranged below a lower guiding portion 432*z*, and the lower guiding portion 432*z* and the carrier cutting portion 421*z* are integrally formed with each other.

FIG. 19A to FIG. 19C show the manner of movement of the guiding unit 430*z* in a stepwise manner.

In such a case, in the same manner as the guiding and cutting unit 420 in the second embodiment, the guiding unit 430*z* cuts the carrier 124 of the terminal connection strip 100*a* by moving the guiding unit 430*z* in the downward direction from a state where the carrier 124 is inserted into a sandwiching portion 423*z* of the carrier cutting portion 421*z*.

This will be described in more detail. As shown in FIG. 19A, the upper guiding portion 431 starts the movement in the downward direction.

Next, as shown in FIG. 19B, the upper guiding portion 431 which moves in the downward direction is brought into contact with the lower guiding portion 432*z* in a state where the carrier 124 is inserted into the sandwiching portion 423*z*. Accordingly, the lower guiding portion 432 is pushed by the upper guiding portion 431 which moves in the downward direction, and is moved in the downward direction integrally with the upper guiding portion 431 so that the carrier 124 inserted into the sandwiching portion 423*z* is cut by the sandwiching portion 423*z* and the pressing lower blade 320.

Then, as shown in FIG. 19C, the guiding unit 430*z* moves to a predetermined position in a state where the upper guiding portion 431 and the lower guiding portion 432 form an integral body. At the same time, in a state where the upper guiding portion 431 and the lower guiding portion 432*z* are combined with each other, the guiding unit 430*z* moves to a position where an opening portion of a tapered inner surface of the guiding unit 430*z* on the distal end side Xa is communicably connected with the wire insertion opening 123 of the female crimp terminal 100.

Accordingly, in the same manner as the wire crimping device in the second embodiment, the processing can be smoothly shifted from the carrier cutting step to the wire insertion step. Further, compared with a wire crimping device where a guiding portion and a carrier cutting portion are formed of separate bodies from each other, the number of parts can be decreased so that a series of operations and the mechanism of the device can be simplified.

The guiding unit 430*z* may be formed of an integral body formed of the upper guiding portion 431 and the lower guiding portion 432*z*.

Fourth Embodiment

A female crimp terminal 100, a wire crimping device 10 and a wire crimping method according to another embodiment are described.

First, the constitution of the wire crimping device 10 at the time of connecting the female crimp terminal 100 and an insulated wire 200 to each other by crimping is described by reference to FIG. 12.

Figure 12:
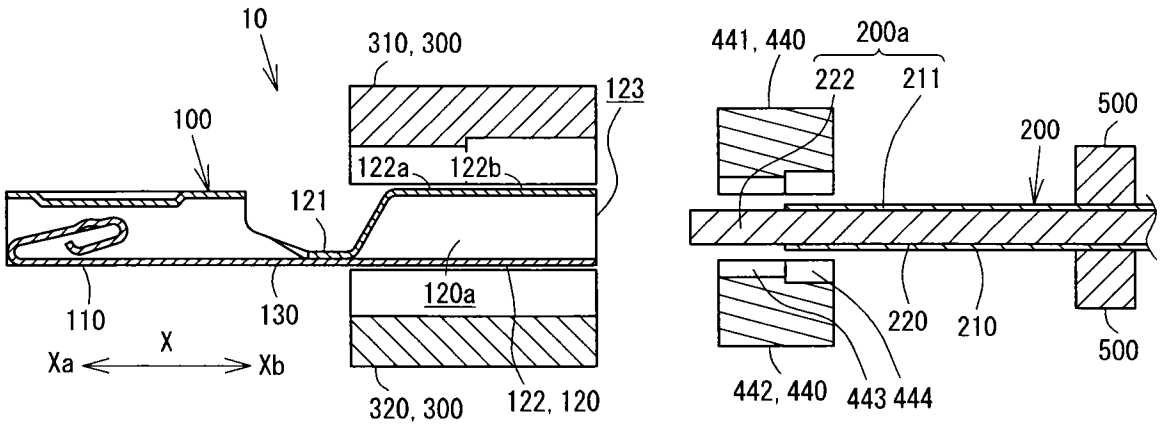
FIG. 12 is an explanatory view for describing a wire crimping device according to a fourth embodiment.

FIG. 12 is a longitudinal cross-sectional view of the wire crimping device 10 for describing the female crimp terminal 100, the insulated wire 200, and the wire crimping device 10.

The constitutions equal to the corresponding constitutions of the above-mentioned first embodiment are given the same symbols, and the detailed explanation of such constitutions is omitted.

As shown in FIG. 12, the wire crimping device 10 is constituted of a wire crimping unit 300, a guiding and gripping unit 440 and a wire gripping unit 500.

The guiding and gripping unit 440 is configured to be vertically split in two parts, and the split parts are arranged so as to face each other in an opposed manner in the vertical direction in a spaced-apart manner. Further, the guiding and gripping unit 440 is arranged on a proximal end side Xb of the wire crimping unit 300 in the long length direction X with a predetermined distance therebetween.

This will be described in more detail. The guiding and gripping unit 440 is formed of an upper guiding portion 441 and a lower guiding portion 442 which are formed by vertically splitting the unit in two parts. In a state where the upper guiding portion 441 and the lower guiding portion 442 are combined with each other in the vertical direction, the guiding and gripping unit 440 has a diameter size that the insulated wire 200 is not movable relative to the guiding and gripping unit 440. A portion of the guiding and gripping unit 440 on the distal end side Xa constitutes a conductor gripping portion 443, and a portion of the guiding and gripping unit 440 on the proximal end side Xb constitutes a cover gripping portion 444. Further, the guiding and gripping unit 440 is configured such that the upper guiding portion 441 and the lower guiding portion 442 are combined with each other by being moved in the long length direction X as well as in the vertical direction from a state where the upper guiding portion 441 and the lower guiding portion 442 are split in two in the vertical direction.

The inner diameter of the guiding and gripping unit 440 is not limited to a size that the insulated wire 200 is not movable relative to the guiding and gripping unit 440. The inner diameter of the guiding and gripping unit 440 may be set to a size that the insulated wire 200 is movable relative to the guiding and gripping unit 440.

Subsequently, a wire crimping method for forming the crimp-terminal-equipped electric wire 1 by connecting the above-mentioned female crimp terminal 100 and insulated wire 200 to each other by crimping is described by reference to FIGS. 4A and 4B, FIGS. 13A and 13B and FIGS. 14A and 14B.

Figure 13A:
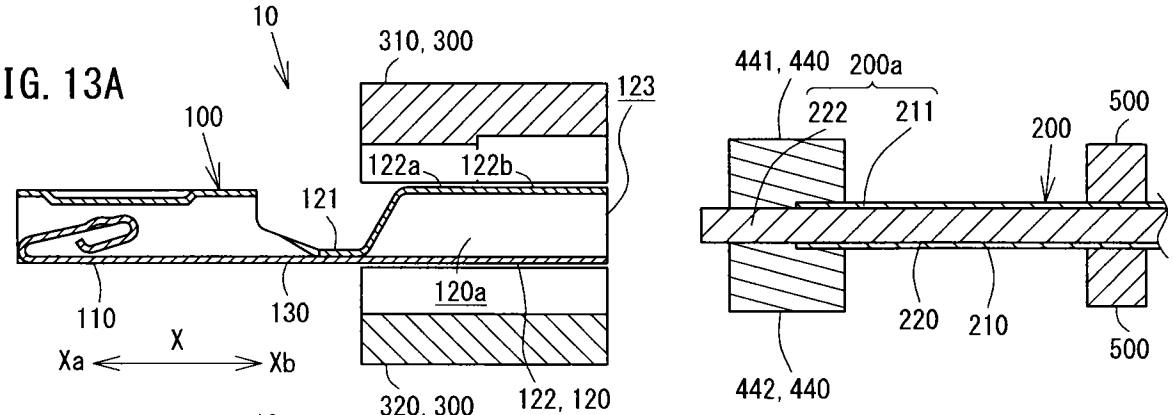
FIGS. 13A and 13B are cross-sectional views for describing a wire guiding step according to the fourth embodiment.
Figure 13B:
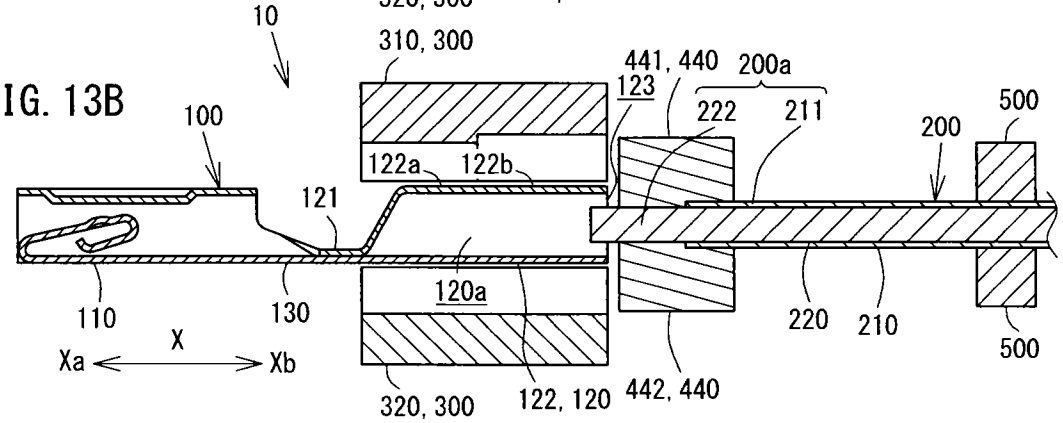
Figure 14A:
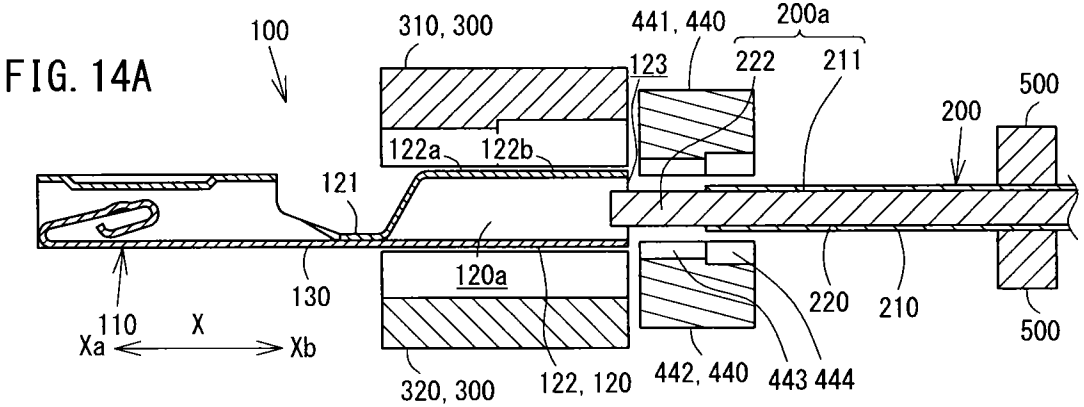
FIGS. 14A and 14B are explanatory views for describing a wire insertion step according to the fourth embodiment.
Figure 14B:
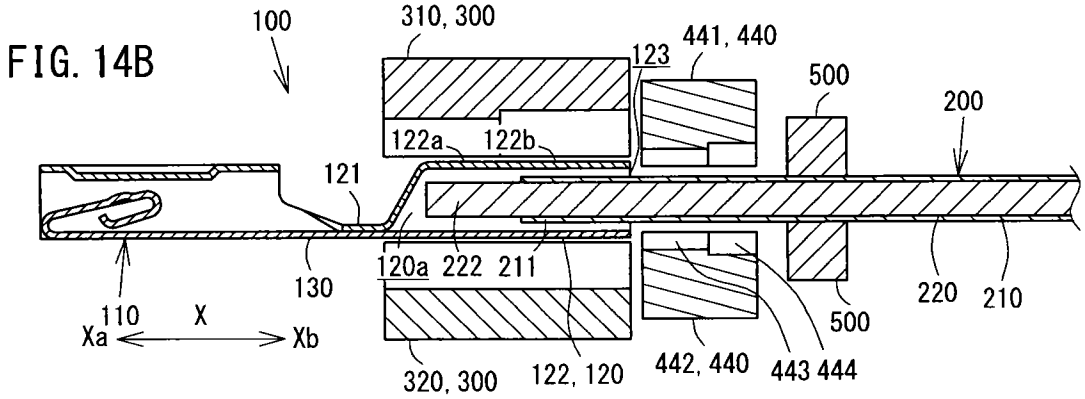

FIG. 13A is a longitudinal cross-sectional view of the wire crimping device 10 for describing a state in the midst of the wire guiding step of guiding a distal end side Xa of a wire tip 200*a* to a wire insertion opening 123. FIG. 13B is a longitudinal cross-sectional view of the wire crimping device 10 for describing a state after the wire guiding step of guiding the distal end side Xa of the wire tip 200*a* to the wire insertion opening 123 is finished. FIG. 14A is a longitudinal cross-sectional view of the wire crimping device 10 for describing a state in the midst of the wire insertion step of inserting the wire tip 200*a* into an insertion space 120*a*. FIG. 14B is a longitudinal cross-sectional view of the wire crimping device 10 for describing a state at the time where the wire insertion step of inserting the wire tip 200*a* into the insertion space 120*a* is finished.

In the wire crimping method, the wire guiding step, the wire insertion step and the crimping connection step are performed in this order. In the wire guiding step, the distal end side Xa of the wire tip 200*a* is guided to a wire insertion opening 123 in a state where the wire tip 200*a* is gripped by the guiding and gripping unit 440.

First, as shown in FIGS. 13A and 13B, when the female crimp terminal 100 is arranged at a predetermined position, the wire crimping device 10 starts the wire guiding step.

This will be described in more detail. As shown in FIG. 13A, the wire crimping device 10 moves the upper guiding portion 441 and the lower guiding portion 442 which are vertically spaced apart from each other in the vertical direction so that the wire tip 200*a* is gripped by the guiding and gripping unit 440. At this point of time, the guiding and gripping unit 440 grips the wire tip 200*a* such that the distal end side Xa of the conductor exposed portion 222 of the wire tip 200*a* is slightly exposed from the distal end side Xa of the guiding and gripping unit 440.

Then, as shown in FIG. 13B, the guiding and gripping unit 440 moves in the long length direction X up to a proximal end side Xb of the crimping section body 122 together with the insulated wire 200 so that the distal end side Xa of the wire tip 200*a* exposed from the guiding and gripping unit 440 is guided to the wire insertion opening 123 of the crimping section 120.

When the wire tip 200*a* is guided to the wire insertion opening 123, as shown in FIGS. 14A and 14B, the wire crimping device 10 starts the wire insertion step.

This will be described in more detail. When the distal end side Xa of the wire tip 200*a* is guided to the wire insertion opening 123, the wire crimping device 10 makes the upper guiding portion 441 and the lower guiding portion 442 of the guiding and gripping unit 440 spaced apart from each other in the vertical direction so that the gripping of the insulated wire 200 by the guiding and gripping unit 440 is released. Further, the wire gripping unit 500 gripping a predetermined position of the insulated wire 200 is moved toward the distal end side Xa in the long length direction X by a predetermined distance.

At this point of time, the wire crimping device 10 makes the wire tip 200*a* of the insulated wire 200 pass through the guiding and gripping unit 440 and the wire insertion opening 123 in this order thus inserting the wire tip 200*a* of the insulated wire 200 into the insertion space 120*a* of the crimping section 120 of the female crimp terminal 100.

When the insulated wire 200 is inserted into the female crimp terminal 100, as shown in FIGS. 4A and 4B, the wire crimping device 10 starts the crimping connection step.

This will be described in more detail. The wire crimping device 10 moves a pressing upper blade 310 and a pressing lower blade 320 of the wire crimping unit 300 toward the crimping section 120 of the female crimp terminal 100 into which the wire tip 200*a* of the insulated wire 200 is inserted such that the crimping section 120 is clamped by the pressing upper blade 310 and the pressing lower blade 320 in the vertical direction. Then, the crimping section 120 is pressed by the pressing upper blade 310 and the pressing lower blade 320 so that the crimping section 120 is plastically deformed whereby the crimping section 120 is connected to the wire tip 200*a* by crimping.

When the crimping section 120 and the wire tip 200*a* are connected to each other by crimping, the wire crimping device 10 moves the wire crimping unit 300, the guiding and gripping unit 440 and the wire gripping unit 500 in the long length direction X as well as in the vertical direction for making the wire crimping unit 300, the guiding and gripping unit 440 and the wire gripping unit 500 away from the female crimp terminal 100, and returns the wire crimping unit 300, the guiding and gripping unit 440 and the wire gripping unit 500 to initial positions.

In the wire guiding step, the wire tip 200*a* is gripped such that the distal end side Xa of the conductor exposed portion 222 of the wire tip 200*a* is slightly exposed from the distal end side Xa of the guiding and gripping unit 440. However, the wire tip 200*a* may be gripped such that the distal end side Xa of the conductor exposed portion 222 of the wire tip 200*a* is not exposed from the distal end side Xa of the guiding and gripping unit 440.

Subsequently, the manner of operation and advantageous effects of the above-mentioned wire crimping device 10 and the manner of operation and advantageous effects of the above-mentioned wire crimping method are described.

In the wire crimping device 10, the distal end side Xa of the wire tip 200*a* is guided to the wire insertion opening 123 in a state where the guiding and gripping unit 440 grips the wire tip 200*a* so that the wire guiding step and the wire insertion step can be smoothly performed.

This will be described in more detail. In the wire crimping device 10, the distal end side Xa of the wire tip 200*a* is slightly exposed from the distal end side Xa of the guiding and gripping unit 440 when the distal end side Xa of the wire tip 200*a* is gripped by the guiding and gripping unit 440 and hence, an exposed portion of the distal end side Xa of the wire tip 200*a* can be directly guided to the wire insertion opening 123. Further, by releasing the gripping of the insulated wire 200, the processing can be smoothly shifted to the wire insertion step.

The guiding and gripping unit 440 may be moved in a state where an end surface of the conductor exposed portion 222 on the distal end side Xa is aligned with an end surface of the guiding and gripping unit 440 on the distal end side Xa or in a state where the end surface of the conductor exposed portion 222 on the distal end side Xa enters the proximal end side Xb of the guiding and gripping unit 440 and, after the guiding and gripping unit 440 is moved, the wire tip 200*a* may be inserted into an insertion space by moving the wire tip 200*a* to the distal end side Xa.

Fifth Embodiment

A female crimp terminal 100, a wire crimping device 10 and a wire crimping method according to another embodiment are described.

First, the constitution of the wire crimping device 10 at the time of connecting the female crimp terminal 100 and an insulated wire 200 to each other by crimping is described by reference to FIG. 15A.

Figure 15A:
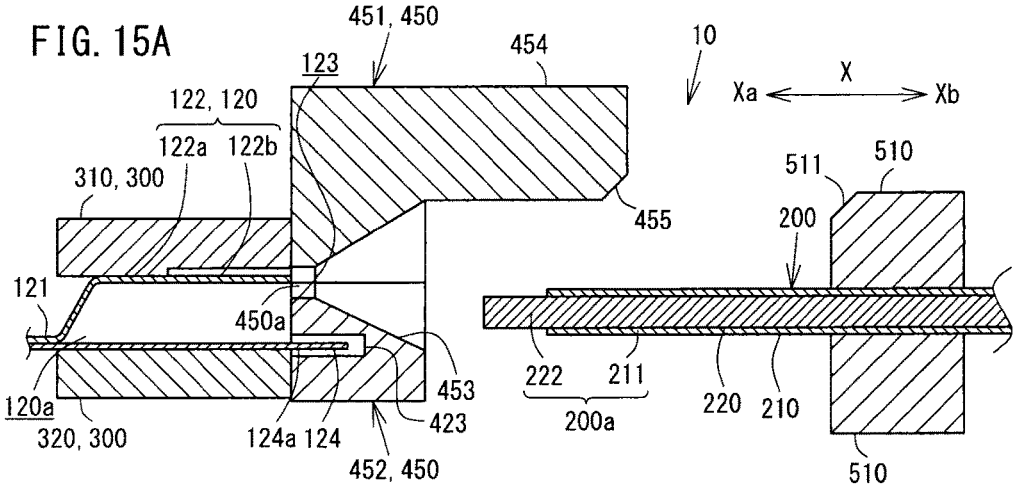
FIGS. 15A and 15B are explanatory views for describing a wire crimping device according to a fifth embodiment.

FIG. 15A is a longitudinal cross-sectional view of the wire crimping device 10 for describing the female crimp terminal 100, the insulated wire 200, and the wire crimping device 10.

The constitutions equal to the corresponding constitutions of the above-mentioned embodiments are given the same symbols, and the detailed explanation of such constitutions is omitted.

Figure 15B:
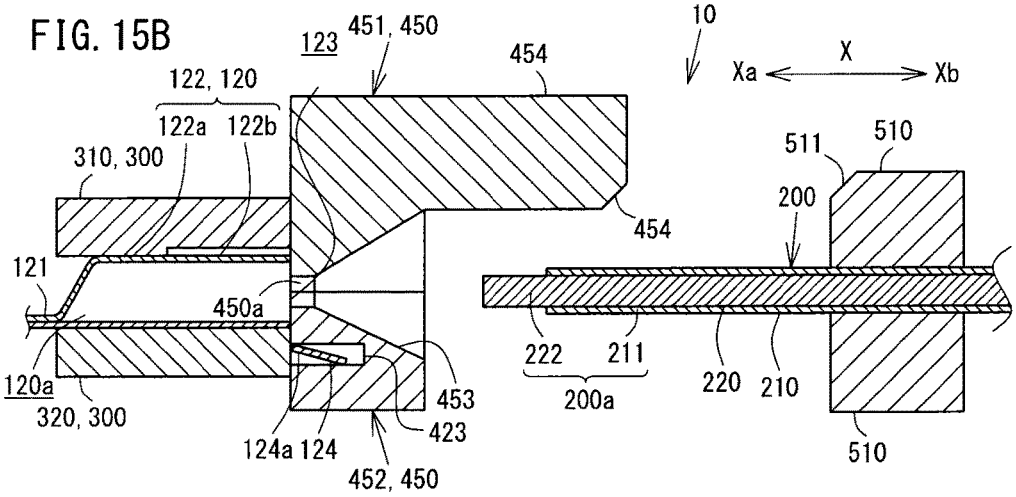

As shown in FIGS. 15A and 15B, the wire crimping device 10 is constituted of a wire crimping unit 300, a guiding and cutting unit 450, and a wire gripping unit 510.

Assume the guiding and cutting unit 450 is in a state where an upper guiding portion 451 and a lower cutting portion 452 which are members formed by dividing the guiding and cutting unit 450 in two in the vertical direction are combined with each other in the vertical direction. In such a state, the guiding and cutting unit 450 is arranged such that an end surface of the guiding and cutting unit 450 on a distal end side Xa is brought into contact with an end surface of a wire crimping unit 300 on a proximal end side Xb, and the guiding and cutting unit 450 is movable in the vertical direction.

The guiding and cutting unit 450 is formed into a hollow shape in a state where the upper guiding portion 451 and the lower cutting portion 452 are combined with each other in the vertical direction. This will be described in more detail. The guiding and cutting unit 450 is formed into a hollow shape having a conductor insertion portion 450*a* and a tapered guide surface 453 in this order. The conductor insertion portion 450*a* has a diameter substantially equal to an outer diameter of a conductor exposed portion 222, and slightly extends along the long length direction X. The guide surface 453 has a diameter gradually increased toward a proximal end side Xb from a distal end side Xa from a diameter size of the conductor insertion portion 450*a* on the proximal end side Xb.

The upper guiding portion 451 has a sliding portion 454 which projects from an upper end of the upper guiding portion 451 toward the proximal end side Xb in the long length direction X. A slide surface 455 is formed on the sliding portion 454 by chamfering a lower end of the sliding portion 454 on a proximal end side Xb by 45°.

A sandwiching portion 423 is formed on the lower cutting portion 452. The sandwiching portion 423 is formed along the width direction Y, and allows the insertion of a carrier 124 of a terminal connection strip 100*a* therein. Further, the lower cutting portion 452 is configured to be movable in the downward direction or in the upward direction in an interlocking manner with the movement of the upper guiding portion 451 in the downward direction or in the upward direction.

As shown in FIG. 15A, a stand-by position where the sandwiching portion 423 formed on the lower cutting portion 452 is positioned on a traffic line of the carrier 124 in the long length direction of the carrier 124 of the terminal connection strip 100*a*, that is, in the width direction Y is assumed as an initial state of the guiding and cutting unit 450. The guiding and cutting unit 450 is movable from the stand-by position to a position where a conductor insertion portion 450*a* of the guiding and cutting unit 450 faces a wire insertion opening 123 of the crimping section 120.

The wire gripping unit 510 differs from the wire gripping unit 500 in the above-mentioned first embodiment with respect to a point that a sliding surface 511 is formed on the wire gripping unit 510. The sliding surface 511 is formed by chamfering an upper end of the wire gripping unit 510 on the distal end side Xa by 45° which faces the slide surface 455 in the long length direction X.

Although described later in detail, in the wire crimping device 10, the wire gripping unit 510 and the upper guiding portion 451 constitute the slide mechanism. The slide mechanism moves, along with the movement of the wire gripping unit 510 to the distal end side Xa in the long length direction X, the upper guiding portion 451 and the lower cutting portion 452 which are combined with each other in the vertical direction such that the upper guiding portion 451 and the lower cutting portion 452 are made spaced-apart from each other in the vertical direction.

Subsequently, a wire crimping method for forming the crimp-terminal-equipped electric wire 1 by connecting the above-mentioned female crimp terminal 100 and insulated wire 200 to each other by crimping is described by reference to FIG. 15B and FIGS. 16A and 16B.

FIG. 15B is a longitudinal cross-sectional view of the wire crimping device 10 describing a state when the carrier cutting step of separating the female crimp terminal 100 and the carrier 124 from each other by the guiding and cutting unit 450 is finished. FIG. 16A is a longitudinal cross-sectional view of the wire crimping device 10 for describing a state in the midst of the wire insertion step of guiding the distal end side Xa of the wire tip 200*a* to the wire insertion opening 123. FIG. 16B is a longitudinal cross-sectional view of the wire crimping device 10 for describing a state when the wire insertion step of guiding the distal end side Xa of the wire tip 200*a* to the wire insertion opening 123 is finished.

In the wire crimping method, the carrier cutting step of separating the female crimp terminal 100 and the carrier 124 from each other, the wire insertion step and the crimping connection step are performed in this order.

First, the wire crimping device 10 starts the carrier cutting step when the female crimp terminal 100 is arranged at a predetermined position.

This will be described in more detail. As shown in FIG. 15B, in the same manner as the carrier cutting step in the second embodiment, in the wire crimping device 10, the female crimp terminal 100 is separated from the terminal connection strip 100*a* using the sandwiching portion 423 formed on the guiding and cutting unit 450 which is moved in the downward direction from the stand-by position. At this point of time, the guiding and cutting unit 450 is moved to a position where the conductor insertion portion 450*a* faces the wire insertion opening 123.

Figure 16A:
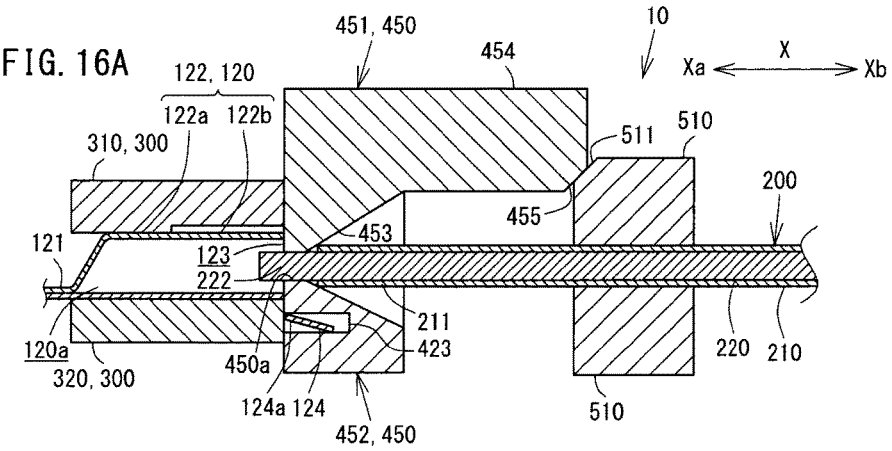
FIGS. 16A and 16B are explanatory views for describing a wire insertion step according to the fifth embodiment.
Figure 16B:
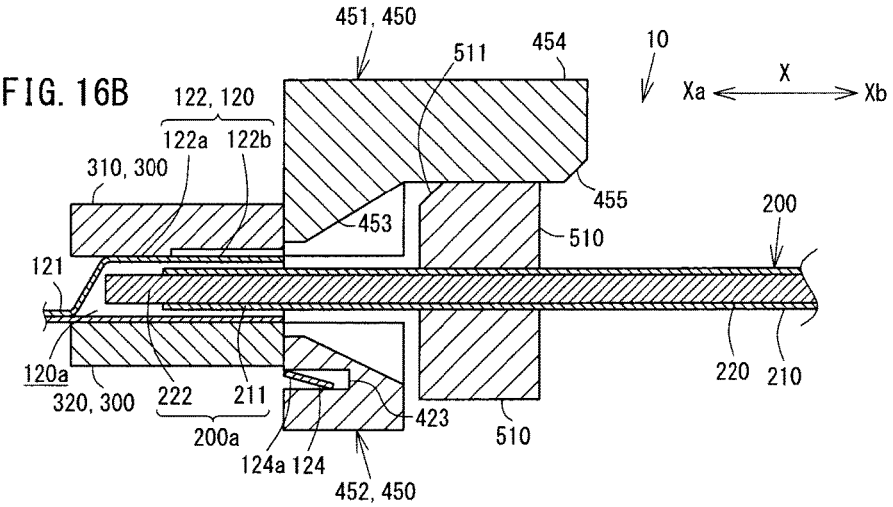

When the female crimp terminal 100 is separated from the terminal connection strip 100*a*, as shown in FIGS. 16A and 16B, the wire crimping device 10 starts the wire insertion step.

This will be described in more detail. As shown in FIG. 16A, the wire crimping device 10 moves the wire gripping unit 510 gripping a predetermined position of the insulated wire 200 to the distal end side Xa in the long length direction X thus inserting a conductor exposed portion 222 of the insulated wire 200 into the conductor insertion portion 450*a* of the guiding and cutting unit 450.

At this point of time, when the center of the insulated wire 200 in the radial direction is deviated from the center of the crimping section 120 in the radial direction, the wire tip 200*a* is guided along the guide surface 453 of the guiding and cutting unit 450 and is inserted into the conductor insertion portion 450*a*. Accordingly, a portion of the conductor exposed portion 222 in the vicinity of the distal end side Xa is positioned in the insertion space 120*a*.

Thereafter, the wire crimping device 10 separates the upper guiding portion 451 and the lower cutting portion 452 from each other in the vertical direction using the slide mechanism, and inserts the insulated cover tip 211 of the wire tip 200*a* into the inside of the insertion space 120*a*.

This will be described in more detail. The wire crimping device 10 moves the wire gripping unit 510 as follows. Along with the movement of the wire gripping unit 510 in the long length direction X, the sliding surface 511 of the wire gripping unit 510 is brought into contact with the slide surface 455 of the upper guiding portion 451 of the guiding and cutting unit 450. Then, when the wire gripping unit 510 is further moved in the long length direction X, the sliding surface 511 pushes the upper guiding portion 451 in the upward direction. Further, when the upper guiding portion 451 starts to move in the upward direction, the lower cutting portion 452 starts to move in the downward direction in an interlocking manner with the movement of the upper guiding portion 451.

In this manner, the wire crimping device 10 moves the upper guiding portion 451 and the lower cutting portion 452 which are combined with each other in the vertical direction in the upward direction and the downward direction, respectively, and at the same time, the sliding portion 454 of the upper guiding portion 451 is supported by the wire gripping unit 510 so that a space which allows the insertion of the insulated cover tip 211 of the wire tip 200*a* therein is formed.

When the upper guiding portion 451 and the lower cutting portion 452 start the separation thereof in the vertical direction, as shown in FIG. 16B, the wire crimping device 10 further moves the wire gripping unit 510 to the distal end side Xa in the long length direction X, and inserts the insulated cover tip 211 of the wire tip 200*a* into the inside of the insertion space 120*a* through the space formed due to the separation of the upper guiding portion 451 and the lower cutting portion 452.

The wire crimping device 10 starts the crimping connection step which is substantially equal to the crimping connection step in the second embodiment when the insulated wire 200 is inserted into the female crimp terminal 100. In the crimping connection step, the crimping section 120 and the wire tip 200*a* are connected to each other by crimping thus forming a crimp-terminal-equipped electric wire 1.

Then, the wire crimping device 10 moves the wire crimping unit 300 in the vertical direction toward the stand-by position and, thereafter, moves the wire gripping unit 510 gripping the crimp-terminal-equipped electric wire 1 to the proximal end side Xb in the long length direction X for removing the crimp-terminal-equipped electric wire 1 from the wire crimping device 10.

At this point of time, with respect to the guiding and cutting unit 450 where the upper guiding portion 451 and the lower cutting portion 452 are separated from each other in the vertical direction by the wire gripping unit 510, the upper guiding portion 451 is moved in the downward direction along with the movement of the wire gripping unit 510, and the lower cutting portion 452 is moved in the upward direction in an interlocking manner with the movement of the upper guiding portion 451 so that the upper guiding portion 451 and the lower cutting portion 452 are combined with each other in the vertical direction. Thereafter, the wire crimping device 10 moves the guiding and cutting unit 450 to the stand-by position.

Subsequently, the manner of operation and advantageous effects of the above-mentioned wire crimping device 10 and the manner of operation and advantageous effects of the above-mentioned wire crimping method are described.

The wire crimping device 10 includes the slide mechanism so that the carrier cutting step and the wire insertion step can be smoothly performed.

This will be described in more detail. In the wire crimping device 10, the conductor insertion portion 450*a* of the upper guiding portion 451 stands by at a position where the conductor insertion portion 450*a* faces the wire insertion opening 123 of the crimping section 120 at a point of time where the carrier cutting step is finished. Accordingly, the processing can be smoothly shifted to the wire insertion step.

Further, the wire crimping device 10 includes the slide mechanism and hence, the crimping device 10 can separate the upper guiding portion 451 and the lower cutting portion 452 from each other while guiding the insulated wire 200. Accordingly, the insulated wire 200 can be inserted into the female crimp terminal 100 more efficiently.

In addition to the above-mentioned advantageous effect, the upper guiding portion 451 and the lower cutting portion 452 are separated from each other by the wire gripping unit 510 and hence, the crimp-terminal-equipped electric wire 1 can be easily removed from the wire crimping device 10 after the crimping connection step is finished.

To describe the correspondence between the constitution of the present invention and the constitution of the above-mentioned embodiments, the crimp terminal of the present invention corresponds to the female crimp terminal 100 in the embodiment.

In the same manner, the conductor of the present invention corresponds to the aluminum lead line 220 in the embodiment, the crimping means of the present invention corresponds to the wire crimping unit 300 in the embodiment, the guiding means of the present invention corresponds to the guiding unit 410, 430, the guiding portion 422, the guiding and cutting unit 450 in the embodiment, the guiding portion of the present invention corresponds to the upper guiding portion 411, 431, 441, 451, the lower guiding portion 412, 432, 442, and the lower cutting portion 452 in the embodiment, the carrier cutting means of the present invention corresponds to the carrier cutting portion 421, and the lower cutting portion 452 in the embodiment, the removal allowing shape of the present invention corresponds to the opening portion 424 in the embodiment, the guiding and gripping means of the present invention corresponds to the guiding and gripping unit 440 in the embodiment, the moving means of the present invention corresponds to the wire gripping unit 500, 510 in the embodiment, the terminal axis direction of the present invention corresponds to the long length direction X in the embodiment, and the carrier long length direction of the present invention corresponds to the width direction Y in the embodiment.

The invention is not limited to the constitution of the above-mentioned embodiments, and the invention can adopt various embodiments.

For example, the present invention is not limited to the female crimp terminal 100 having the box section 110, and may be a male crimp terminal having a connection tab or a crimp terminal formed of only the crimping section 120.

Figure 20A:
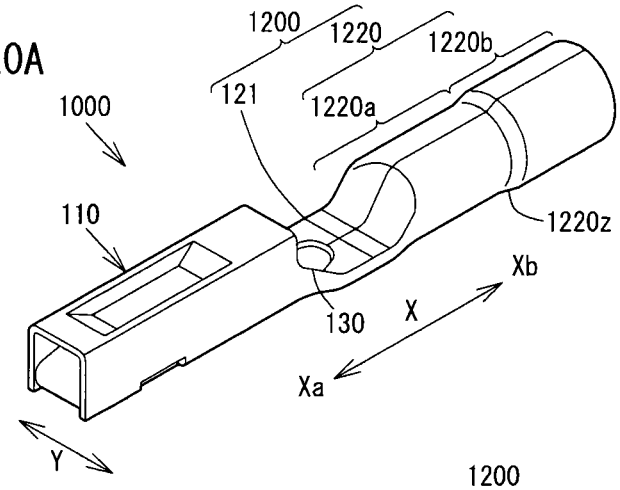
FIGS. 20A to 20C are explanatory views for describing a female crimp terminal according to another embodiment.
Figure 20B:
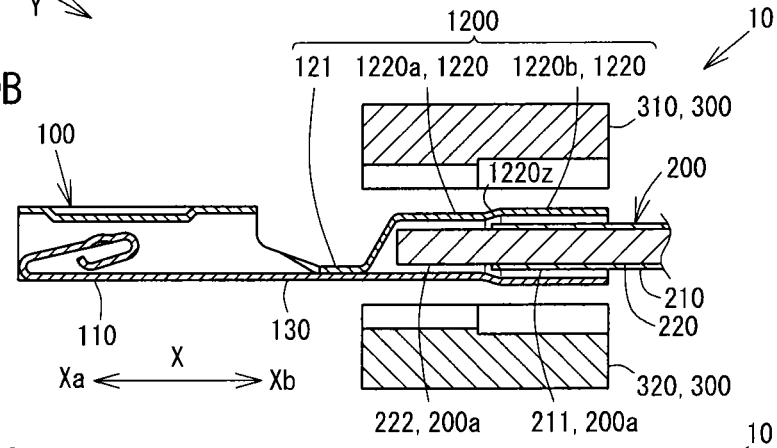
Figure 20C:
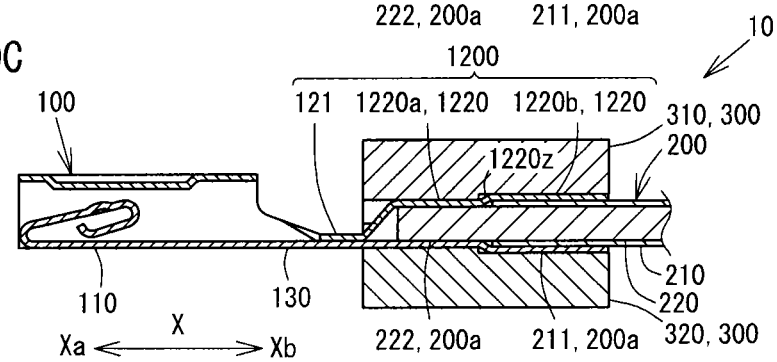

Further, the female crimp terminal of the present invention is not limited to the configuration where the inner diameter of the conductor crimping section 122*a* and the inner diameter of the cover crimping section 122*b* are set equal to each other. As shown in FIG. 20A to FIG. 20C, the female crimp terminal may be a female crimp terminal 1000 formed into a stepped shape where an inner diameter of a cover crimping section 1220*b* is set larger than an inner diameter of a conductor crimping section 1220*a*.

FIG. 20A is a perspective view of the female crimp terminal 1000. FIG. 20B is a longitudinal cross-sectional view of the wire crimping device 10 for describing a state after a wire insertion step. FIG. 20C is a longitudinal cross-sectional view of the wire crimping device 10 for describing a state after a crimping connection step.

Figure 21A:
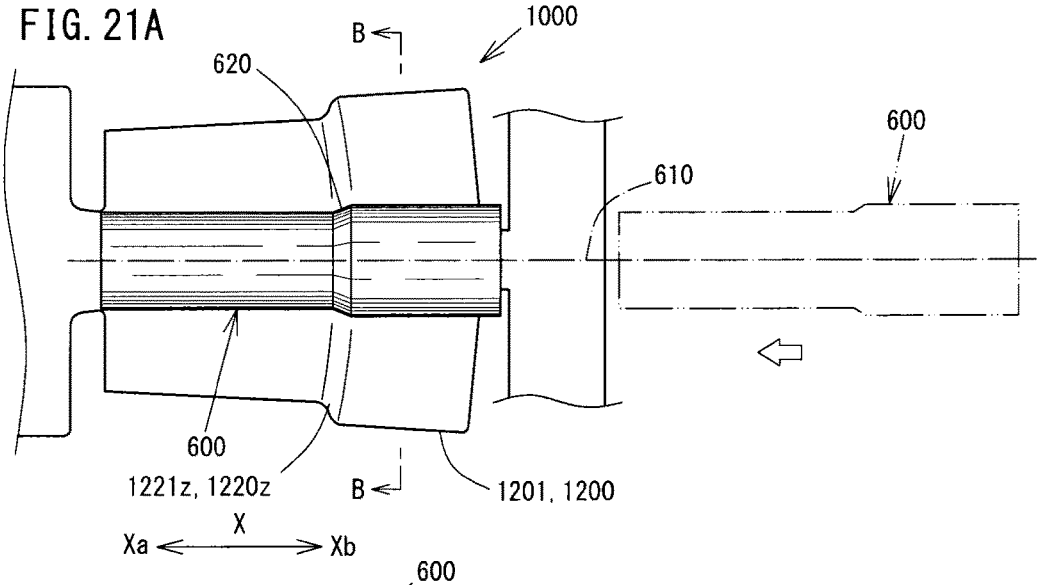
FIGS. 21A to 21D are explanatory views for describing a method of manufacturing a female crimp terminal according to another embodiment where a crimping section body has a stepped shape.
Figure 21B:
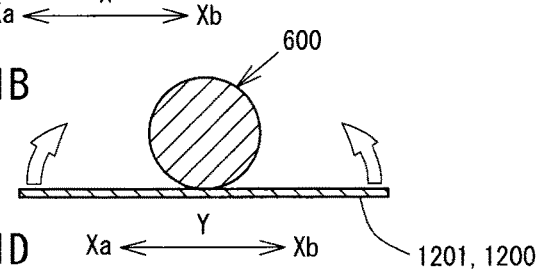
Figure 21D:
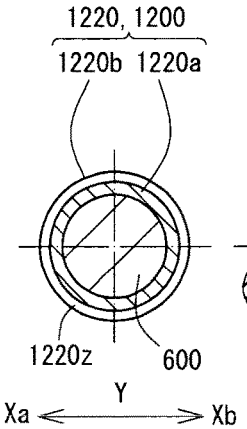
Figure 21C:
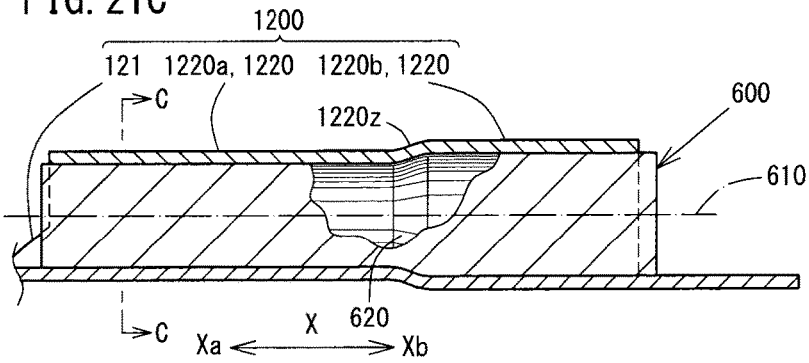

FIG. 21A is a plan view showing a state where a core rod 600 is arranged at a crimping section corresponding portion 1201. FIG. 21B is a cross-sectional view taken along line B-B in FIG. 21A. FIG. 21C is a longitudinal cross-sectional view in a state where the crimping section 1200 is formed into a hollow shape. FIG. 21D is a cross-sectional view taken along line C-C in FIG. 21C.

As shown in FIG. 20A to FIG. 20C, in the crimping section body 1220, a diameter of the conductor crimping section 1220*a* is set substantially equal to or slightly larger than an outer diameter of the conductor exposed portion 222, and a diameter of the cover crimping section 1220*b* is set substantially equal to or slightly larger than an outer diameter of the insulated cover tip 211.

A stepped portion 1220*z* of the crimping section body 1220 is formed into a stepped shape which is gradually and smoothly lowered from the cover crimping section 1220*b* to the conductor crimping section 1220*a* instead of a stepped shape which is orthogonal to the long length direction X.

Various types of manufacturing methods can be considered as a method of manufacturing the female crimp terminal 1000 having the crimping section body 1220 formed into the stepped shape in this manner. However, it is preferable to manufacture the female crimp terminal 1000 using a core rod 600 (see FIG. 21A).

A method of manufacturing the female crimp terminal 1000 using the core rod 600 is described in detail. First, a terminal substrate is formed into a shape where a hollow crimping section 1200 having a stepped shape is developed in plane by blanking.

Then, as shown in FIG. 21A, the core rod 600 is placed on the terminal substrate such that, in a state where a core rod axis 610 of the core rod 600 formed into the stepped shape extends along the long length direction X, the stepped portion 620 of the core rod 600 is positioned at a stepped portion corresponding portion 1221*z* corresponding to the stepped portion 1220*z* of the crimping section 1200.

Next, as shown in FIG. 21B, both end portions in the width direction Y of the crimping section corresponding portion 1201 corresponding to the crimping section 1200 are bent around the core rod axis 610 and, as shown in FIG. 21C and FIG. 21D, are formed into a hollow shape by a press die not shown in the drawing such that the crimping section corresponding portion 1201 surrounds the core rod 600.

Subsequently, the manner of operation and advantageous effects of the above-mentioned female crimp terminal 1000 having the crimping section body 1220 formed into the stepped shape is described by reference to FIG. 22 and FIG. 23.

Figure 22:
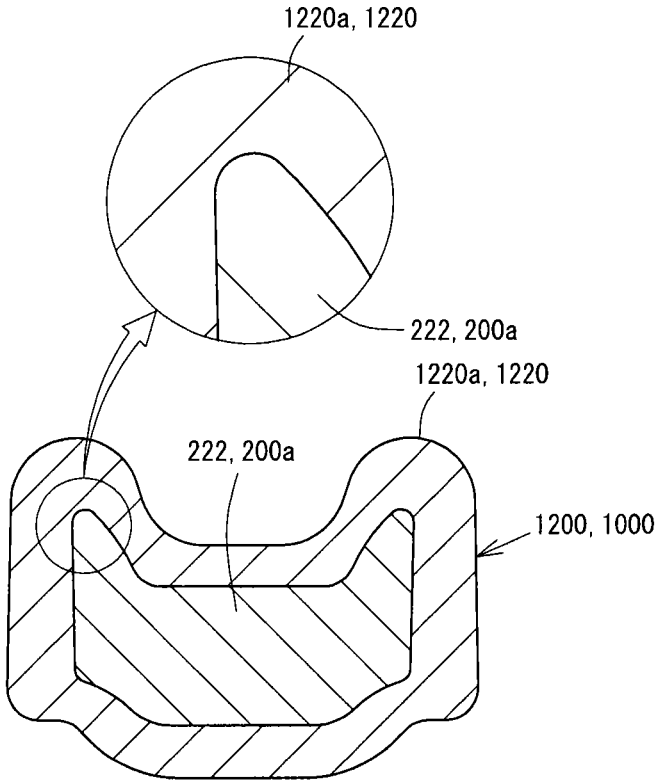
FIG. 22 is a cross-sectional view for describing a crimping section body which is formed into a stepped shape according to another embodiment.
Figure 23:
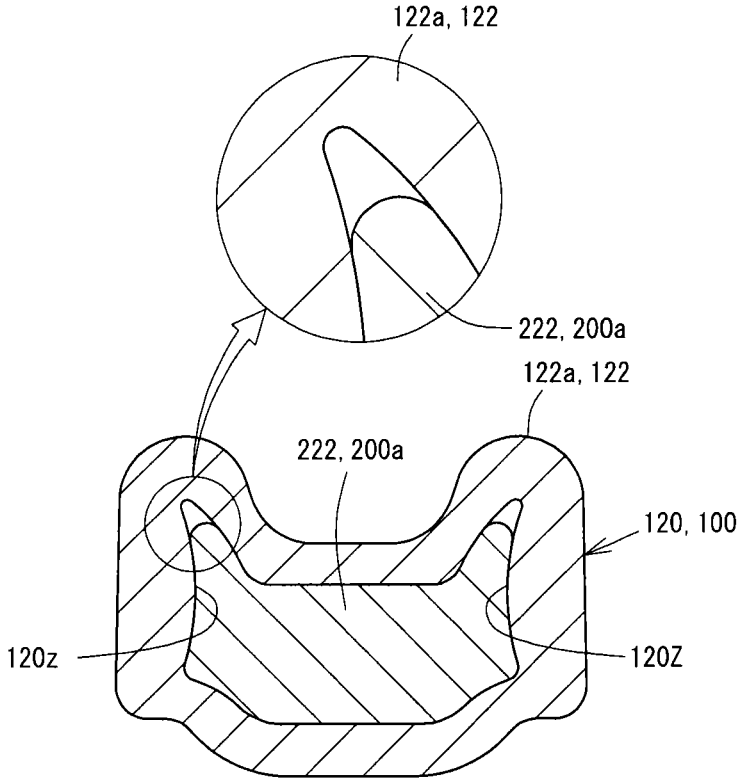
FIG. 23 is a cross-sectional view for describing a crimping section body which has a uniform inner diameter according to another embodiment.

FIG. 22 is a cross-sectional view of the conductor crimping section 1220*a* after the crimping connection step when the crimping section body 1220 is formed into a stepped shape. FIG. 23 is a cross-sectional view of the conductor crimping section 122*a* after the crimping connection step when the crimping section body 122 is not formed into the stepped shape.

A gap formed between the conductor crimping section 1220*a* and the conductor exposed portion 222 is small in the crimping section body 1220 formed into a stepped shape compared with a gap formed between the conductor crimping section 122*a* and the conductor exposed portion 222 in the crimping section body 122 which is not formed into a stepped shape. Accordingly, in the crimping section body 1220, a deformation amount of the conductor crimping section 1220*a* in the radially inward direction is small at the time of connecting the conductor crimping section 1220*a* to the conductor exposed portion 222 by crimping so that the formation of an excessively large thick wall portion can be prevented To describe the above in other words, a gap formed between the conductor crimping section 122*a* and the conductor exposed portion 222 is large in the conventional crimping section body 122 which is not formed into the stepped shape compared with a gap formed between the conductor crimping section 1220*a* and the conductor exposed portion 222 in the crimping section body 1220 formed into a stepped shape. Accordingly, in the conventional crimping section body 122, a deformation amount of the conductor crimping section 122*a* in the radially inward direction is large at the time of connecting the conductor crimping section 122*a* to the conductor exposed portion 222 by crimping.

A deformation amount of the conventional conductor crimping section 122*a* in the radially inward direction is large in the crimping section body 122. Accordingly, an excessively large thick wall portion is generated at the time of connecting the conductor crimping section 122*a* to the conductor exposed portion 222 by crimping and hence, as shown in FIG. 23, an inwardly-falling portion 120*z* is generated where the excessively large thick wall portion projects in a falling manner in the radially inward direction in the crimping section body 122.

In the crimping section body 122 having the inwardly-falling portion 120*z*, the inwardly-falling portion 120*z* becomes an obstacle when the crimping section body 122 is connected to the wire tip 200*a* by crimping. Accordingly, the conductor exposed portion 222 does not reach a corner portion of the conductor crimping section 122*a* and hence, there exists a possibility that a gap is generated between the conductor crimping section 122*a* and the conductor exposed portion 222 as shown in an enlarged view in FIG. 23.

The crimping section body 122 where the gap is generated between the conductor crimping section 122*a* and the conductor exposed portion 222 has, in a state where the conductor crimping section 122*a* and the conductor exposed portion 222 are connected to each other by crimping, the deteriorated electrical connection or the moisture intrusion due to the capillarity. Accordingly, such a crimping section body 122 has deteriorated electrical characteristics.

On the other hand, the crimping section body 1220 formed into the stepped shape has a small gap formed between the conductor crimping section 1220*a* and the conductor exposed portion 222 compared with the crimping section body 122 which is not formed into the stepped shape. Accordingly, even when the crimping section body 1220 and the wire tip 200*a* are connected to each other by crimping, there is no possibility that the inwardly-falling portion 120*z* is generated in the conductor crimping section 1220*a* so that the conductor crimping section 1220*a* and the conductor exposed portion 222 can be connected to each other by crimping in a state where the conductor crimping section 1220*a* and the conductor exposed portion 222 are brought into close contact with each other. Accordingly, the deterioration of the electrical characteristics can be prevented.

Further, the stepped portion 1220*z* of the crimping section body 1220 is formed into a stepped shape which is gradually and smoothly lowered from the cover crimping section 1220*b* to the conductor crimping section 1220*a* and hence, the wire tip 200*a* can be easily inserted into the insertion space 1200*a*.

Further, the above-mentioned female crimp terminal 1000 is manufactured using the core rod 600 and hence, even when the female crimp terminal 1000 is mass produced, a position of the stepped portion 1220*z* in the crimping section body 1220 is not changed for the respective female crimp terminals 1000, and the stepped portion 1220*z* can be formed at a desired position.

This will be described in more detail. Assume a case where the conductor crimping section is formed with a length larger than a desired length in the long length direction X. As described above, the crimping section body is formed into a stepped shape so as to make a gap formed between the conductor crimping section and the conductor exposed portion 222 and a gap formed between the cover crimping section and the insulated cover tip 211 small. Accordingly, there is a possibility that the insulated cover tip 211 is caught by the stepped portion of the crimping section body at the time of inserting the wire tip 200*a* into the insertion space so that the wire tip 200*a* cannot be sufficiently inserted into the insertion space.

In contrast, assume a case where the cover crimping section is formed with a length larger than the desired length in the long length direction X. In such a case, even when a tip of the conductor exposed portion 222 impinges on a distal end portion of the crimping section body, the insertion of the wire tip 200*a* is continued until the insulated cover tip 211 impinges on the stepped portion of the crimping section body. Accordingly, there is a possibility that a tip of the conductor exposed portion 222 is bent.

Assume the case where the cover crimping section is formed with a length larger than a desired length in the long length direction X. In such a case, even when the insertion of the wire tip 200*a* is stopped immediately before the tip of the conductor exposed portion 222 impinges on the tip of the crimping section body 1220, the cover crimping section is positioned around a portion of the conductor exposed portion 222 on the proximal end side Xb. Accordingly, a gap formed between the proximal end side Xb of the conductor exposed portion 222 and the crimping section body is larger than a gap formed between the distal end side Xa of the conductor exposed portion 222 and the crimping section body. That is, in such a case, there is a possibility that the conductor crimping section forms an inwardly-falling portion 120*z* when the conductor crimping section is connected to the conductor exposed portion 222 by crimping.

On the other hand, in the female crimp terminal 1000 having the stepped portion 1220*z* at the desired position, there is no possibility that the insertion of the wire tip 200*a* into the insertion space 1200*a* is insufficient, that a tip of the conductor exposed portion 222 is bent or that a gap formed between the conductor crimping section 1220*a* and the conductor exposed portion 222 becomes large. Accordingly, the wire tip 200*a* can be inserted into the insertion space 1200*a* at the desired position.

The desired position as used herein means a position where a boundary portion between the conductor exposed portion 222 and the cover tip 211 agrees with the stepped portion 1220*z* of the crimping section body 1220 in the long length direction X.

By forming the crimping section 1200 into a hollow shape in a state where the stepped portion corresponding portion 1221*z* of the crimping section corresponding portion 1201 and the stepped portion 620 of the core rod 600 are aligned with each other with high accuracy, it is possible to maintain a state where the crimping section body 1220 and the wire tip 200*a* are closely connected to each other by crimping. Accordingly, a terminal-equipped wire having favorable electrical connection can be acquired.

Further, the female crimp terminal 1000 formed into the stepped shape as described above allows the insertion of the wire tip 200*a* toward the center of a wire insertion opening by the guiding units 410, 430, the guiding and cutting units 420, 450, and the guiding and gripping unit 440 of the present invention. Accordingly, it is possible to prevent the wire tip 200*a* from being brought into contact with the stepped portion 1220*z* of the female crimp terminal 1000.

Accordingly, even when a diameter of the conductor crimping section 1220*a* is set substantially equal to or slightly larger than an outer diameter of the conductor exposed portion 222 and a diameter of the cover crimping section 1220*b* is set substantially equal to or slightly larger than an outer diameter of the insulated cover tip 211, the wire tip 200*a* can be surely inserted into the insertion space 1200*a* without causing a defect that the wire tip 200*a* is brought into contact with the stepped portion 1220*z* so that the aluminum raw wires 221 are loosened or a defect that the conductor exposed portion 222 is bent.

DESCRIPTION OF REFERENCE SIGNS

10: Wire crimping device
100, 1000: Female crimp terminal
100*a*: Terminal connection strip
120, 1200: Crimping section
122, 1220: Crimping section body
123: Wire insertion opening
124: Carrier
124*a*: Connecting portion
200: Insulated wire
200*a*: Wire tip
210: Insulating cover
220: Aluminum lead line
300: Wire crimping unit
310: Pressing upper blade
320: Pressing lower blade
410, 430: Guiding unit
411, 431, 441, 451: Upper guiding portion
412, 432, 442: Lower guiding portion
420, 450: Guiding and cutting unit
421: Carrier cutting portion
422: Guiding portion
440: Guiding and gripping unit
452: Lower cutting portion
500, 510: Wire gripping unit
X: Long length direction
Y: Width direction
Xa: Distal end side
Xb: Proximal end side

The invention claimed is:

1. A wire crimping device by which an insulated wire formed by covering a conductor with an insulating cover and provided with a wire tip formed by exposing the conductor by peeling off the insulating cover on a first end side, and a closed-barrel-type crimp terminal provided with a hollow crimping section which allows the crimping connection of the wire tip are connected to each other by crimping the crimping section and the wire tip to each other, the wire crimping device comprising:

a crimper configured to crimp the crimping section into which the wire tip is inserted from a wire insertion opening which opens on a second end side of the crimping section in a terminal axis direction, the second end side being different from the first end side;

a guide configured to guide an end portion of the conductor to the wire insertion opening of the crimp terminal arranged at a predetermined position for enabling crimping by the crimper, an inner diameter of an opposedly-facing portion of the guide, which is opposite to the wire insertion opening corresponding to an inner diameter of the wire insertion opening; and a carrier cutter configured to separate a plurality of crimp terminals from a carrier of a terminal connection strip, the carrier formed in a strip-shape, the terminal connection strip formed by connecting the plurality of crimp terminals to the carrier via connecting portions at predetermined intervals in a longest length direction of the carrier, wherein the carrier cutter is configured to shear the connecting portions in a thickness direction of the carrier by sliding in the thickness direction of the carrier from a stand-by position where the carrier cutter overlaps with the wire insertion opening to a cutting position which is disposed on a side opposite to a side where the crimping section is arranged with respect to the carrier, the cutting position being a position where the carrier cutter does not overlap with the wire insertion opening, and the guide is disposed at a position in the carrier cutter, which is made to slide to the cutting position, which corresponds to the wire insertion opening, in the cutting position.

2. The wire crimping device according to claim 1, wherein the guide is formed into a removal-allowing shape to allow insertion of the insulated wire with the wire tip guided to the wire insertion opening and removal of the insulated wire in a direction which intersects with the terminal axis direction after crimping of the crimping section by the crimper.

3. The wire crimping device according to claim 2, wherein the removal-allowing shape is a C-shape as viewed in the terminal axis direction.

4. A wire crimping device by which an insulated wire formed by covering a conductor with an insulating cover and provided with a wire tip formed by exposing the conductor by peeling off the insulating cover on a first end side, and a closed-barrel-type crimp terminal provided with a hollow crimping section which allows the crimping connection of the wire tip are connected to each other by crimping the crimping section and the wire tip to each other, the wire crimping device comprising:

a crimper including:

a conductor-crimping section configured to crimp a conductor exposed portion of the wire tip; and a cover-crimping section configured to crimp an insulated cover portion of the wire tip at a portion closer to a second end side than the conductor-crimping section, and to crimp the crimping section of the crimp terminal into which the wire tip is inserted from a wire insertion opening which opens on a third end side of the cover crimping section in a terminal axis direction;

a guide configured to guide a first end side portion of the conductor to the wire insertion opening of the crimp terminal arranged at a predetermined position to enable crimping by the crimper; and a carrier cutter configured to separate a plurality of crimp terminals from a carrier of a terminal connection strip, the carrier formed in a strip-shape, the terminal connection strip formed by connecting the plurality of crimp terminals to the carrier via connecting portions at predetermined intervals in a longest length direction of the carrier, wherein the carrier cutter is configured to shear the connecting portions in a thickness direction of the carrier by sliding in the thickness direction of the carrier from a stand-by position where the carrier cutter overlaps with the wire insertion opening to a cutting position which is disposed on a side opposite to a side where the crimping section of the crimp terminal is arranged with respect to the carrier, the cutting position being a position where the carrier cutter does not overlap with the wire insertion opening, wherein the guide is configured such that an inner diameter of an oppsedly-facing portion of the guide, which is opposite to the wire insertion opening, corresponds to an inner diameter of the cover crimping section, and the guide is disposed at a position in the carrier cutter, which is made to slide to the cutting position so that the guide corresponds to the wire insertion opening, in the cutting position.

5. The wire crimping device according to claim 4, wherein the guide is formed into a removal-allowing shape to allow insertion of the insulated wire with the wire tip guided to the wire insertion opening and removal of the insulated wire in a direction which intersects with the terminal axis direction after crimping of the crimping section by the crimper.

6. The wire crimping device according to claim 5, wherein the removal-allowing shape is a C-shape as viewed in the terminal axis direction.

7. The wire crimping device according to claim 4, wherein the guide is formed into a shape where an inner diameter of the guide gradually increases toward the second end side in the terminal axis direction.

* * * * *